US011800285B2

(12) United States Patent
Yoshioka et al.

(10) Patent No.: US 11,800,285 B2
(45) Date of Patent: Oct. 24, 2023

(54) DISPLAY DEVICE

(71) Applicant: Sony Group Corporation, Tokyo (JP)

(72) Inventors: Hiroshi Yoshioka, Kanagawa (JP); Tomohiro Suzuki, Kanagawa (JP); Daisuke Miki, Tokyo (JP); Masao Zen, Chiba (JP); Tetsuo Ikeyama, Kanagawa (JP)

(73) Assignee: Sony Group Corporation

( * ) Notice: Subject to any disclaimer, the term of this patent is extended or adjusted under 35 U.S.C. 154(b) by 45 days.

(21) Appl. No.: 17/629,611

(22) PCT Filed: Jul. 17, 2020

(86) PCT No.: PCT/JP2020/027789
§ 371 (c)(1),
(2) Date: Jan. 24, 2022

(87) PCT Pub. No.: WO2021/020158
PCT Pub. Date: Feb. 4, 2021

(65) Prior Publication Data

US 2022/0248138 A1 Aug. 4, 2022

(30) Foreign Application Priority Data

Jul. 31, 2019 (JP) ..... 2019-140677

(51) Int. Cl.
*H04R 3/12* (2006.01)
*H04R 1/02* (2006.01)
(Continued)

(52) U.S. Cl.
CPC ..... *H04R 3/12* (2013.01); *H04R 1/028* (2013.01); *H04R 1/403* (2013.01); *H04R 7/04* (2013.01);
(Continued)

(58) Field of Classification Search
CPC ..... H04R 3/12; H04R 1/028; H04R 1/403; H04R 7/04; H04R 2201/028; H04R 2499/15
(Continued)

(56) References Cited

U.S. PATENT DOCUMENTS 9,596,531 B1 * 3/2017 Zhang ..... H04R 1/028
9,820,055 B2 * 11/2017 Babayoff ..... H04R 17/025
(Continued)

FOREIGN PATENT DOCUMENTS

DE 102020129117 A1 7/2021
JP S6077179 U 5/1985
(Continued)

OTHER PUBLICATIONS

International Search Report for International Application No. PCT/JP2020/027789 dated Oct. 20, 2020, pp. 1-3.

*Primary Examiner* — Disler Paul
(74) *Attorney, Agent, or Firm* — Lerner David LLP

(57) ABSTRACT

The display device is provided which includes a signal processing unit that processes an image signal and a sound signal, a plate-like panel unit that displays an image according to the image signal, and a vibration unit that is deployed on the rear face side of the panel unit and causes the panel unit to vibrate in response to the sound signal. The vibration unit includes a plurality of vibrators, and the signal processing unit outputs the sound signal not only to a sound output vibrator that is a vibrator of an output target of the sound signal from among the plurality of vibrators but also to a dispersion sound output vibrator that is a vibrator of a dispersion target of the sound signal. The present technology can be applied, for example, to a television receiver.

22 Claims, 16 Drawing Sheets

(51) Int. Cl.
*H04R 1/40* (2006.01)
*H04R 7/04* (2006.01)

(52) U.S. Cl.
CPC .... *H04R 2201/028* (2013.01); *H04R 2499/15* (2013.01)

(58) Field of Classification Search
USPC ..... 381/333, 388, 401, 406
See application file for complete search history.

(56) References Cited

U.S. PATENT DOCUMENTS

| | | | |
|---|---|---|---|
| 2009/0161880 | A1 | 6/2009 | Hooley |
| 2018/0343512 | A1 | 11/2018 | Choi |
| 2019/0045301 | A1 | 2/2019 | Family |

FOREIGN PATENT DOCUMENTS

| | | | |
|---|---|---|---|
| JP | 2007043452 | A | 2/2007 |
| JP | 2017187734 | A | 10/2017 |
| JP | 2018093469 | A | 6/2018 |

* cited by examiner

DISPLAY DEVICE

CROSS-REFERENCE TO RELATED APPLICATIONS

This application is a national phase entry under 35 U.S.C. § 371 of International Application No. PCT/JP2020/027789 filed Jul. 17, 2020, which claims the priority from Japanese Patent Application No. 2019-140677 filed in the Japanese Patent Office on Jul. 31, 2019, the entire contents of which are hereby incorporated by reference.

TECHNICAL FIELD

The present technology relates to a display device, and particularly relates to a display device that makes it possible to suppress the influence of heat generation with a higher degree of certainty.

BACKGROUND ART

In recent years, reduction in thickness and weight of a display has proceeded. Further, also for a speaker, reduction in thickness and weight has proceeded, and it has been proposed to use a flat panel speaker (FPS: Flat Panel Speaker) in place of a speaker of the cone type. Furthermore, also it has been proposed to use a display panel as a vibration plate in a flat panel speaker.

In a display and a speaker of the type described, there is a possibility that heat generation may have an influence on operation, and therefore, a countermeasure against heat generation is required. As a technology relating to a countermeasure against heat generation, for example, technologies disclosed in PTL 1 to PTL 3 are known.

CITATION LIST

Patent Literature

[PTL 1]
Japanese Patent Laid-Open No. 2018-093469
[PTL 2]
Japanese Patent Laid-Open No. 2017-187734
[PTL 3]
Japanese Patent Laid-Open No. 2007-043452

SUMMARY

Technical Problem

However, the technologies relating to a countermeasure against heat generation described above are not sufficient as a countermeasure for a flat panel speaker in which a display panel is used as a vibration plate, and it is demanded to suppress the influence of heat generation with certainty.

The present technology has been made in view of such a situation as described above and makes it possible to suppress the influence of heat generation with a higher degree of certainty.

Solution to Problem

The display device of one aspect of the present technology is a display device including a signal processing unit that processes an image signal and a sound signal, a plate-like panel unit that displays an image according to the image signal, and a vibration unit that is deployed on a rear face side of the panel unit and causes the panel unit to vibrate in response to the sound signal, in which the vibration unit includes a plurality of vibrators, and the signal processing unit outputs the sound signal not only to a sound output vibrator that is a vibrator of an output target of the sound signal from among the plurality of vibrators but also to dispersion sound output vibrators that are vibrators of dispersion targets of the sound signal.

In the display device of one aspect of the present technology, a signal processing unit that processes an image signal and a sound signal, a plate-like panel unit that displays an image according to the image signal, and a vibration unit that is deployed on the rear face side of the panel unit and causes the panel unit to vibrate in response to the sound signal, are provided. A plurality of vibrators is provided in the vibration unit, and, from the signal processing unit, the sound signal is outputted not only to a sound output vibrator that is a vibrator of an output target of the sound signal from among the plurality of vibrators but also to dispersion sound output vibrators that are vibrators of dispersion targets of the sound signal.

It is to be noted that the display device of the one aspect of the present technology may be an independent device or may otherwise be an internal block that configures one device.

DESCRIPTION OF EMBODIMENT

In the following, an embodiment of the present technology is described with reference to the drawings. It is to be noted that the description is given in the following order.

1. Embodiment of the Present Technology
2. Modifications

1. Embodiment of the Present Technology

<1. (Example of Configuration of Display Device)

Figure 1:
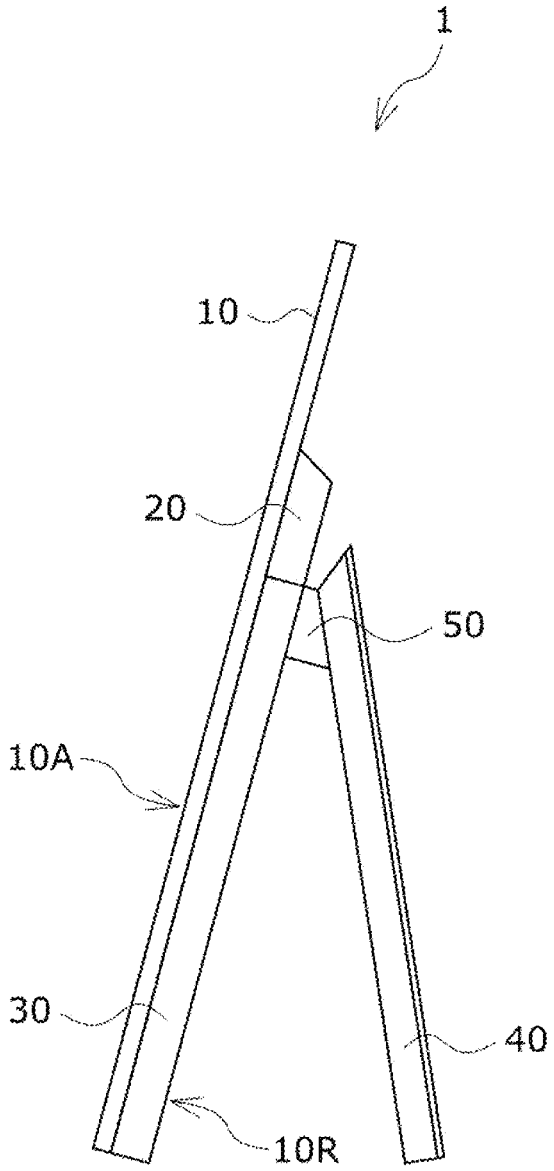
FIG. 1 is a view depicting an example of a configuration of a side face of a display device to which the present technology is applied.
Figure 2:
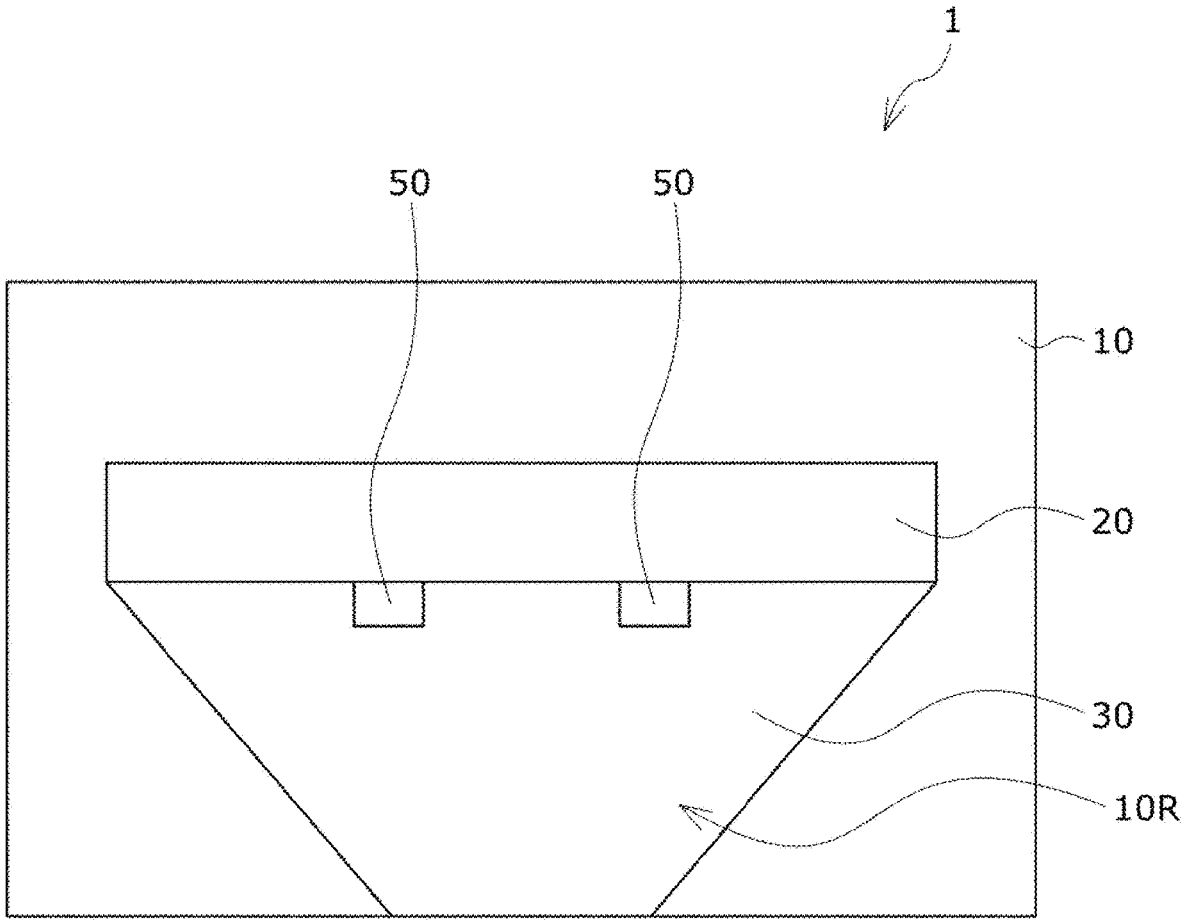
FIG. 2 is a view depicting an example of a configuration of a rear face of the display device to which the present technology is applied.

FIG. 1 depicts an example of a configuration of a side face of a display device 1 as an example of a configuration of an embodiment of the display device to which the present technology is applied. Further, an example of a configuration of a rear face of the display device 1 is depicted in FIG. 2.

The display device 1 is configured as a television receiver or the like. The display device 1 displays an image on an image displaying face 10A and outputs sound from the image displaying face 10A. In particular, the display device 1 has a flat panel speaker built therein.

The display device 1 includes a panel unit 10 that displays an image and also functions as a vibration plate, and a vibration unit 20 that is deployed on the rear face of the panel unit 10 and causes the panel unit 10 to vibrate. The display device 1 further includes a signal processing unit 30 that controls the panel unit 10 and the vibration unit 20, and a support unit 40 that supports the panel unit 10 thereon through a pivot unit 50.

The vibration unit 20 and the signal processing unit 30 are deployed on the rear face of the panel unit 10. The panel unit 10 has, on the rear face side thereof, a rear cover 10R that protects the vibration unit 20 and the signal processing unit 30. The rear cover 10R includes a metal plate or a resin plate in the form of a plate and is connected to the pivot unit 50.

Figure 3:
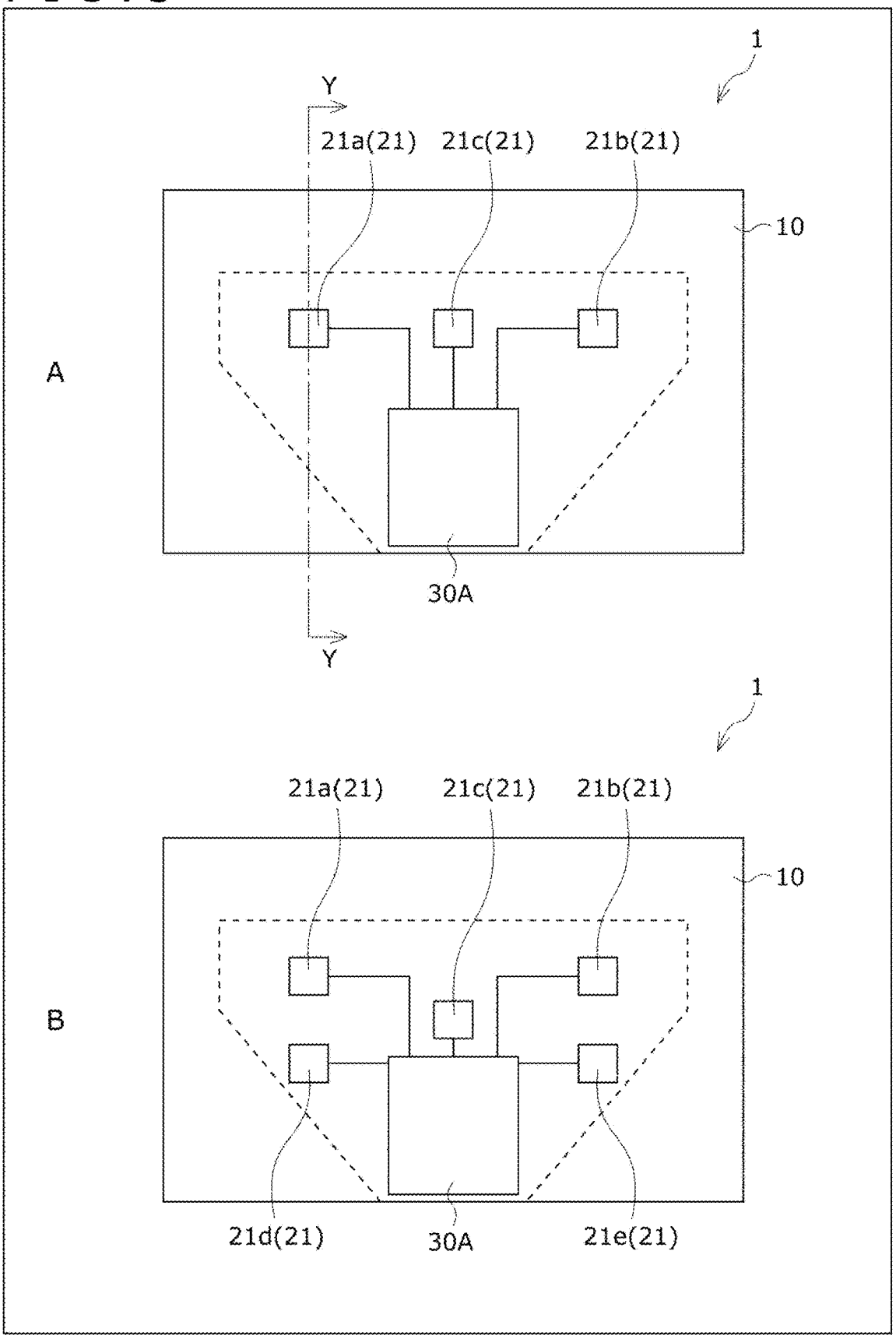
FIG. 3 illustrates views each depicting an example of a configuration of a rear face of the display device when a back chassis is removed.

FIG. 3 depicts an example of a configuration of the rear face of the display device 1 when the rear cover 10R is removed. In FIG. 3, a circuit board 30A equivalent to the signal processing unit 30 is exemplified.

Figure 4:
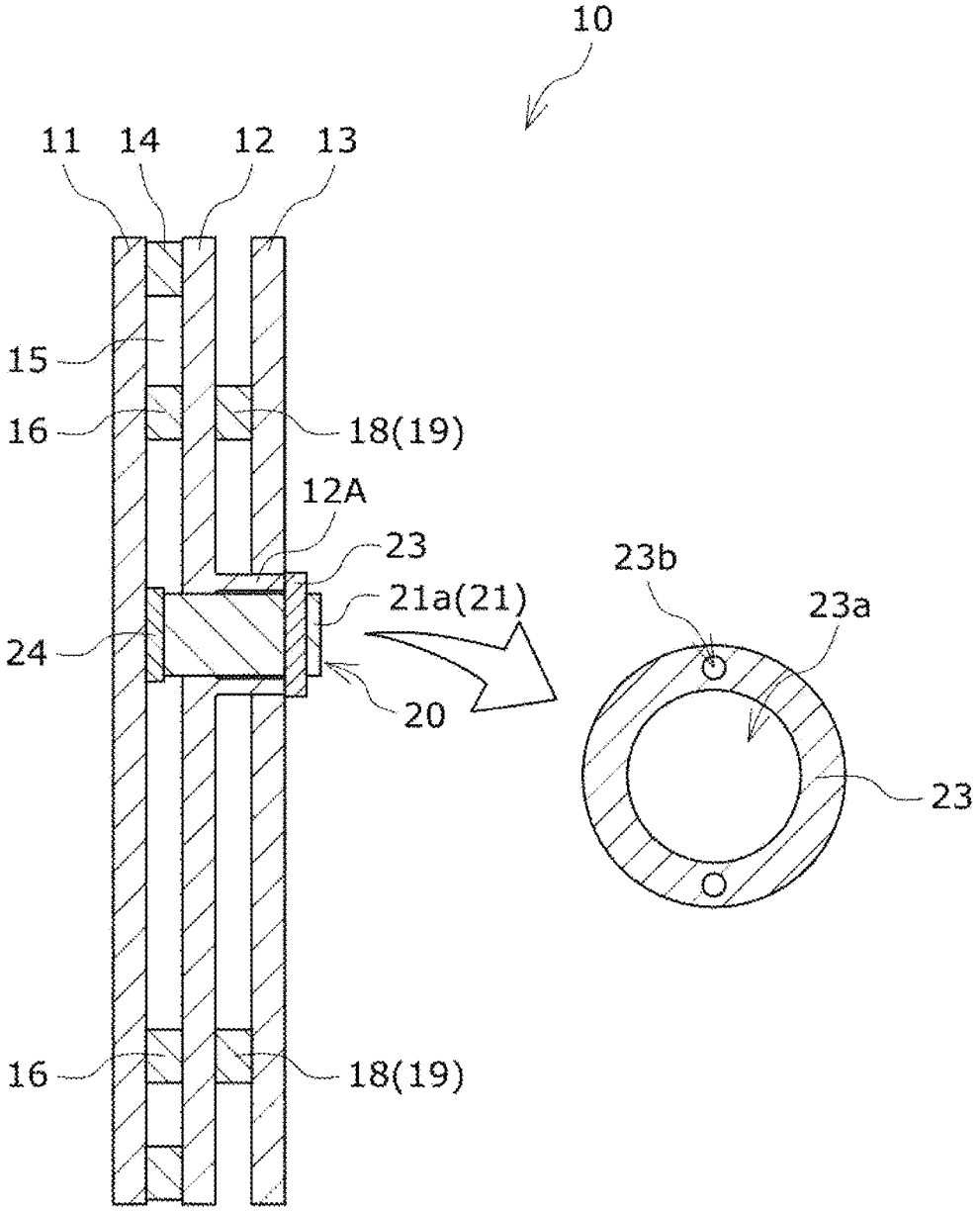
FIG. 4 is a view depicting a configuration of a cross section taken along line Y-Y of FIG. 3.

A of FIG. 3 depicts a configuration in a case where three vibrators 21 (21*a*, 21*b*, and 21*c*) are provided in the vibration unit 20, and an example of a configuration of a cross section taken along line Y-Y of A of FIG. 3 is depicted in FIG. 4. It is to be noted that B of FIG. 3 depicts a configuration in a case where five vibrators 21 (21*a*, 21*b*, 21*c*, 21*d*, and 21*e*) are provided in the vibration unit 20.

The panel unit 10 includes a display cell 11 in the form of a thin plate for displaying an image, an inner plate 12 (opposed plate) deployed in an opposed relationship to the display cell 11 with an air gap 15 left therebetween, and a back chassis 13.

The surface of the display cell 11 (surface on the opposite side to the vibration unit 20) serves as the image displaying face 10A. The panel unit 10 further includes a fixing member 14 between the display cell 11 and the inner plate 12.

The fixing member 14 is deployed along an outer edge of the display cell 11 and has a function for fixing the display cell 11 and the inner plate 12 to each other and a function as a spacer for keeping the air gap 15.

The inner plate 12 is a board that supports the vibrators 21*a*, 21*b*, and 21*c*. The inner plate 12 has openings for a vibrator at locations thereof at which the vibrators 21*a*, 21*b*, and 21*c* are to be installed.

The back chassis 13 has rigidity higher than that of the inner plate 12 and has a role of suppressing deflection and vibration of the inner plate 12. Further, the back chassis 13 has openings at positions opposed to the openings of the inner plate 12 (openings for the vibrators and so forth). From among the openings provided in the back chassis 13, the openings provided at the positions opposed to the openings for a vibrator have a size sufficient to allow the vibrators 21*a*, 21*b*, and 21*c* to fit therein.

The vibration unit 20 includes the three vibrators 21*a*, 21*b*, and 21*c*. The vibrators 21*a*, 21*b*, and 21*c* have configurations common to each other. When the display cell 11 is viewed from the rear face side, the vibrator 21*a* is deployed at a rather left position, the vibrator 21*b* is deployed at a rather right position, and the vibrator 21*c* is deployed in the middle in the leftward and rightward direction. The vibrators 21*a*, 21*b*, and 21*c* are deployed in a lined up in the leftward and rightward direction of the display cell 11 and are deployed at a rather upper position than the middle in the upward and downward direction.

Each of the vibrators 21*a*, 21*b*, and 21*c* includes, for example, a voice coil, a bobbin around which the voice coil is wound, and a magnetic circuit, and is an actuator for a speaker, which serves as a vibration source.

In each of the vibrators 21*a*, 21*b*, and 21*c*, if sound current of an electric signal flows to the voice coil, then driving force is generated in the voice coil in accordance with the principle of electromagnetic action. This driving force is transmitted to the display cell 11 through a vibration transmission member 24 hereinafter described and causes the display cell 11 to generate vibration according to a change of the sound current, whereupon the air vibrates and the sound pressure changes.

The vibration unit 20 further includes a fixing unit 23 and a vibration transmission member 24 for each of the vibrators 21*a*, 21*b*, and 21*c*. The fixing unit 23 has an opening 23*a* for fixing the vibrators 21*a*, 21*b*, and 21*c* in a state where they are fitted therein and a plurality of threaded holes 23*b* for allowing screws, which are to be used when the fixing unit 23 is to be fixed to a projection 12A, to be fitted therein. The vibrators 21*a*, 21*b*, and 21*c* are fixed to the inner plate 12 through the fixing units 23.

The vibration transmission member 24 is held in contact, for example, with the rear face of the display cell 11 and with the bobbin of the vibrators 21*a*, 21*b*, and 21*c* and is fixed to the rear face of the display cell 11 and the bobbin of the vibrators 21*a*, 21*b*, and 21*c*. The vibration transmission member 24 includes a member having a characteristic that it repels at least in a sound wave region (20 Hz or more).

The panel unit 10 includes damping members 16 between the display cell 11 and the inner plate 12. The damping members 16 act to prevent vibrations generated in the display cell 11 by the vibrators 21*a*, 21*b*, and 21*c* from interfering with each other.

The panel unit 10 further includes an adhesion layer 18 or an adhesive layer 19 deployed between the inner plate 12 and the back chassis 13. The adhesion layer 18 or the adhesive layer 19 is a layer for fixing the inner plate 12 and the back chassis 13 to each other.

It is to be noted that, although the foregoing description is given focusing on the configuration that the three vibrators 21*a*, 21*b*, and 21*c* are provided in the vibration unit 20, the number and the deployment positions of the vibrators 21 to be deployed on the display cell 11 of the panel unit 10 that functions also as the vibration plate are optional such that the five vibrators 21*a*, 21*b*, 21*c*, 21*d*, and 21*e* are provided, in the deployment as illustrated B of FIG. 3.

(Example of Deployment of Vibrators)

Figure 5:
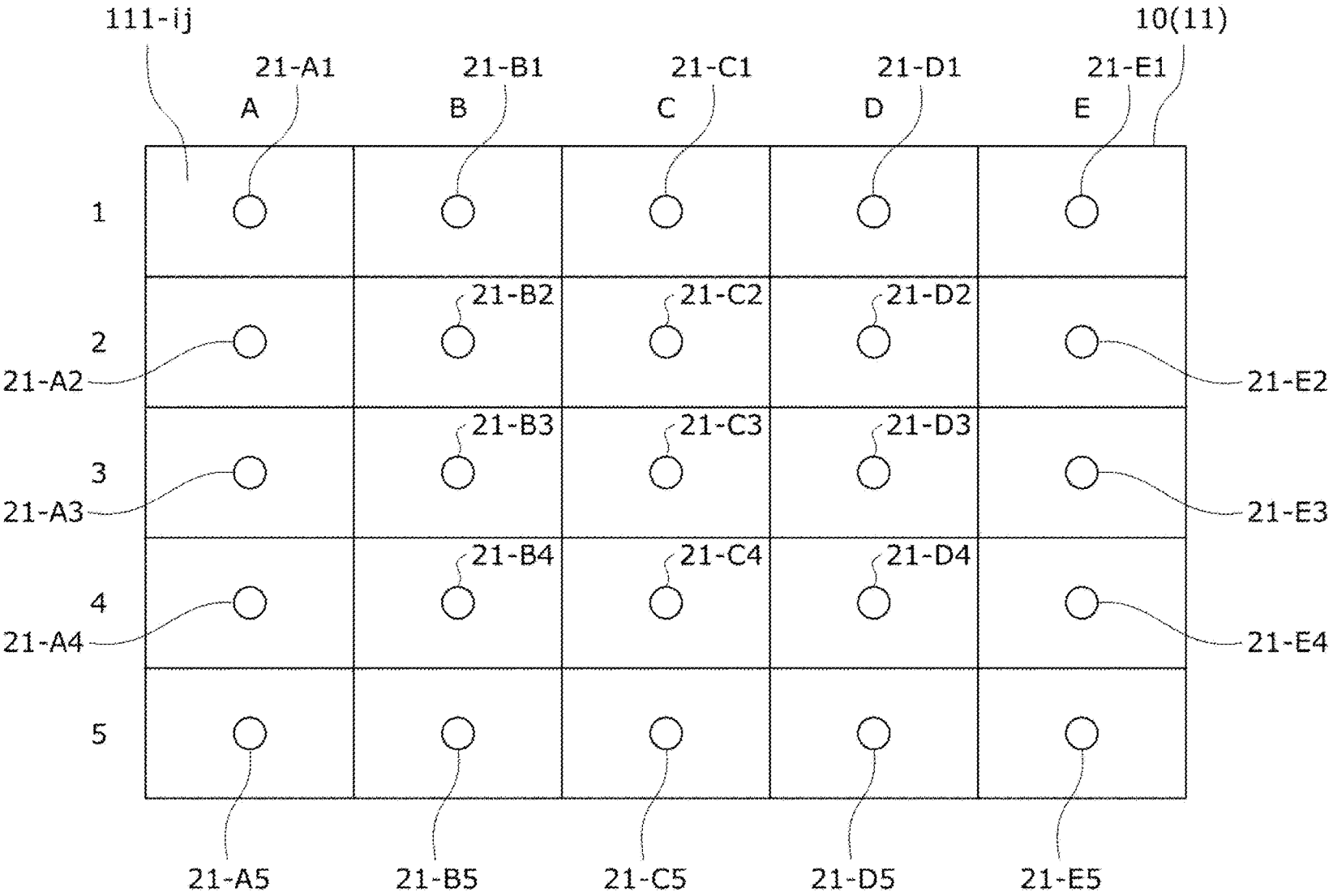
FIG. 5 is a view depicting an example of deployment of a vibrator deployed on a display cell of a display panel.

FIG. 5 depicts an example of deployment of the vibrators 21 deployed on the display cell 11 of the panel unit 10.

FIG. 5 depicts a case in which the area of an overall screen of the display cell 11 of the panel unit 10 is divided in the vertical direction and the horizontal direction into 5×5 regions of a same size and a vibrator 21 is deployed in each of the divisional regions.

In the following, each region of the screen divided into 5×5 is referred to as a divisional block 111. It is to be noted that, in FIG. 5, numbers (1 to 5) and letters (A to E) corresponding to the numbers in the vertical direction and the horizontal direction of the divisional blocks 111 are written in the left and upper side regions of the screen of the panel unit 10 for the convenience of description. Further, in the writing of each divisional block 111-*ij*, i represents a character in the horizontal direction, and j represents a number in the vertical direction.

In the panel unit 10, for each of the 5×5 divisional blocks 111, a vibrator 21 represented by a white round mark (o) is provided at the center of the region, and a total of 25 vibrators 21 are deployed.

If attention is paid to the column A, then in the divisional block 111-A1, a vibrator 21-A1 is provided at the center in the region. Similarly, in the divisional blocks 111-A2 to 111-A5, vibrators 21-A2 to 21-A5 are provided at the center of the individual regions, respectively.

If attention is paid to the column B, then in the divisional blocks 111-B1 to 111-B5, vibrators 21-B1 to 21-B5 are provided, respectively. Meanwhile, if attention is paid to the column C, then in the divisional blocks 111-C1 to 111-C5, vibrators 21-C1 to 21-C5 are provided at the center of the individual regions, respectively.

If attention is paid to the column D, then in the divisional blocks 111-D1 to 111-D5, vibrators 21-D1 to 21-D5 are provided at the center in the regions, respectively. Further, if attention is paid to the column E, then in the divisional blocks 111-E1 to 111-E5, vibrators 21-E1 to 21-E5 are provided at the center of the individual regions, respectively.

(Example of Configuration of Signal Processing Unit)

Figure 6:
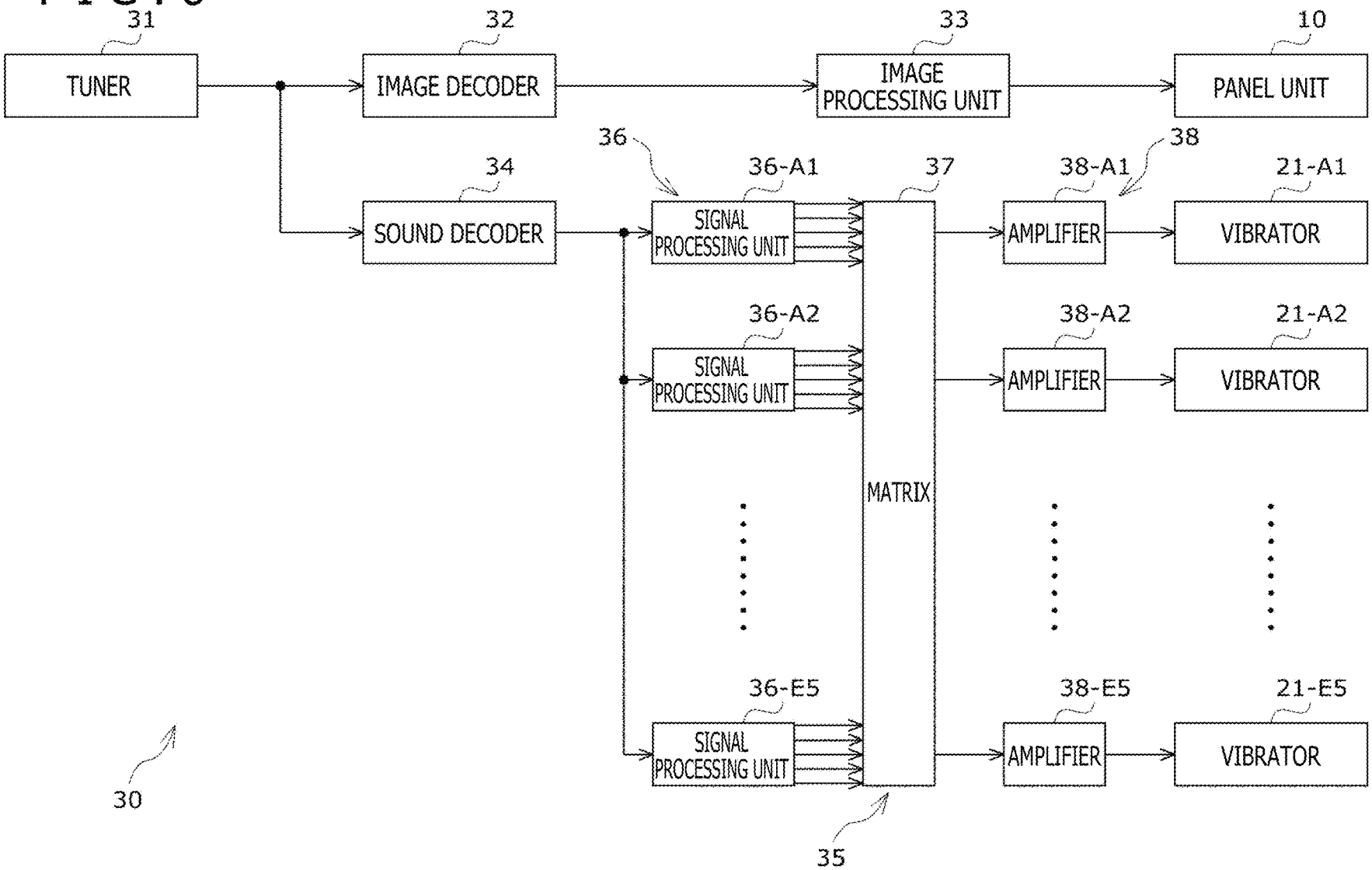
FIG. 6 is a view depicting an example of a configuration of a signal processing unit.

FIG. 6 depicts an example of a configuration of (the 5×5 vibrators 21 provided in) the signal processing unit 30 that are ready for the 5×5 divisional blocks 111 of FIG. 5).

Referring to FIG. 6, the signal processing unit 30 includes a tuner 31, an image decoder 32, an image processing unit 33, a sound decoder 34, and a sound processing unit 35.

The tuner 31 processes a broadcasting signal received by a reception antenna (not depicted) to extract a broadcasting stream according to a channel selected by a user. The tuner 31 outputs an image stream and a sound stream from within the extracted broadcasting stream to the image decoder 32 and the sound decoder 34, respectively.

The image decoder 32 performs a decoding process for the image stream inputted from the tuner 31 and outputs an image signal obtained as a result of the process to the image processing unit 33.

The image processing unit 33 includes a panel driver and drives (the display cell 11 of) the panel unit 10 on the basis of the image signal inputted from the image decoder 32. Consequently, an image according to the image signal is displayed on the panel unit 10.

The sound decoder 34 performs a decoding process for the sound stream inputted from the tuner 31 and outputs a sound signal obtained as a result of the process to the sound processing unit 35.

The sound processing unit 35 performs predetermined signal processing for the sound signal inputted from the sound decoder 34. The sound processing unit 35 generates a sound signal to be outputted to each of the 5×5 vibrators 21 provided individually for the 5×5 divisional blocks 111 (FIG. 5).

The sound processing unit 35 includes a signal processing unit 36, a matrix 37, and an amplifier 38. A plurality of the signal processing units 36 and the amplifiers 38 are provided corresponding to the vibrators 21 provided individually for the 5×5 divisional blocks 111. It is to be noted that details of signal processing performed by the signal processing units 36 and the matrix 37 in the sound processing unit 35 are hereinafter described.

The signal processing units 36 include signal processing units 36-A1 to 36-A5, 36-B1 to 36-B5, 36-C1 to 36-C5, 36-D1 to 36-D5, and 36-E1 to 36-E5. The amplifiers 38 include the amplifiers 38-A1 to 38-A5, 38-B1 to 38-B5, 38-C1 to 38-C5, 38-D1 to 38-D5, and 38-E1 to 38-E5.

It is to be noted that, in the following description, a sound signal corresponding to the vibrator 21-A1 is referred to as a sound signal A1. Similarly, sound signals corresponding to the vibrators 21-A2 to 21-A5, 21-B1 to 21-B5, 21-C1 to 21-C5, 21-D1 to 21-D5, and 21-E1 to 21-E5 are referred to as sound signals A2 to A5, B1 to B5, 01 to C5, D1 to D5, and μl to E5, respectively.

The sound processing unit 35 amplifies the sound signal A1 generated by the signal processing unit 36 and the matrix 37 with the amplifier 38-A1 and outputs the amplified sound signal A1 to the vibrator 21-A1 to drive the vibrator 21-A1. Further, the sound processing unit 35 amplifies the sound signals A2 to A5 generated by the signal processing units 36 and the matrix 37 with the amplifiers 38-A2 to 38-A5 and outputs the amplified sound signals A2 to A5 to drive the vibrators 21-A2 to 21-A5, respectively.

Similarly, the sound processing unit 35 amplifies sound signals B1 to B5 generated by the signal processing unit 36 and the matrix 37 with the amplifiers 38-B1 to 38-B5 and outputs the amplified sound signals B1 to B5 to drive the vibrators 21-B1 to 21-B5, respectively. Further, the sound processing unit 35 amplifies sound signals C1 to C5 generated by the signal processing unit 36 and the matrix 37 with the amplifiers 38-C1 to 38-C5 and outputs the amplified sound signals C1 to C5 to drive the vibrators 21-C1 to 21-C5, respectively.

Similarly, the sound processing unit 35 amplifies sound signals D1 to D5 generated by the signal processing unit 36 and the matrix 37 with the amplifiers 38-D1 to 38-D5 and outputs the amplified sound signals D1 to D5 to drive the vibrators 21-D1 to 21-D5, respectively. Further, the sound processing unit 35 amplifies sound signals μl to E5 generated by the signal processing unit 36 and the matrix 37 with the amplifiers 38-E1 to 38-E5 and outputs the amplified sound signals μl to E5 to drive the vibrators 21-E1 to 21-E5, respectively.

The display device 1 is configured in such a manner as described above.

(Example of Screen Multiplexing Drive)

Now, details of the screen multiplexing drive to which the present technology is applied are described.

In the screen multiplexing drive to which the present technology is applied, not only a vibrator 21 of an output target (hereinafter referred to as a sound output vibrator) corresponding to a position of a sound source is caused to vibrate, but the sound signal is dispersed to another vibrator 21 of a dispersion target (hereinafter referred to also as a dispersion sound output vibrator) to cause the vibrator 21 to vibrate such that generated heat of the sound output vibrator is dispersed to the dispersion sound output vibrator.

In particular, in the display device 1, if only the vibrator 21 (sound output vibrator) corresponding to the position of the sound source is caused to vibrate, then the vibrator 21 generates heat, and there is a possibility that the heat may have an influence on picture quality of an image to be displayed on the display cell 11 of the panel unit 10 that functions also as a vibration plate.

Therefore, in the screen multiplexing drive to which the present technology is applied, a sound signal is dispersed to and reproduced by the other vibrator 21 (dispersion sound output vibrator) deployed in the surrounding area or the like of the vibrator 21 corresponding to the position of the sound source (sound output vibrator) thereby to perform dispersion of heat such that the influence of heat on the picture quality of an image to be displayed on the display cell 11 is reduced.

Further, if a sound signal is dispersed uniformly to other vibrators 21 deployed in the surrounding area or the like (dispersion sound output vibrators), then the position of the sound source is split, resulting in impair of the localization.

In the screen multiplexing drive to which the present technology is applied, a sound signal to be dispersed to other vibrators 21 deployed in the surrounding area of a vibrator 21 corresponding to the position of a sound source, namely, to dispersion sound output vibrators other than the desired output sound vibrator, undergoes delaying such that the localization is improved by the preceding sound effect. In short, even in a case where a sound signal is dispersed to and reproduced by dispersion sound output vibrators, the localization of the sound output position is prevented from being impaired due to the preceding sound effect.

Figure 7:
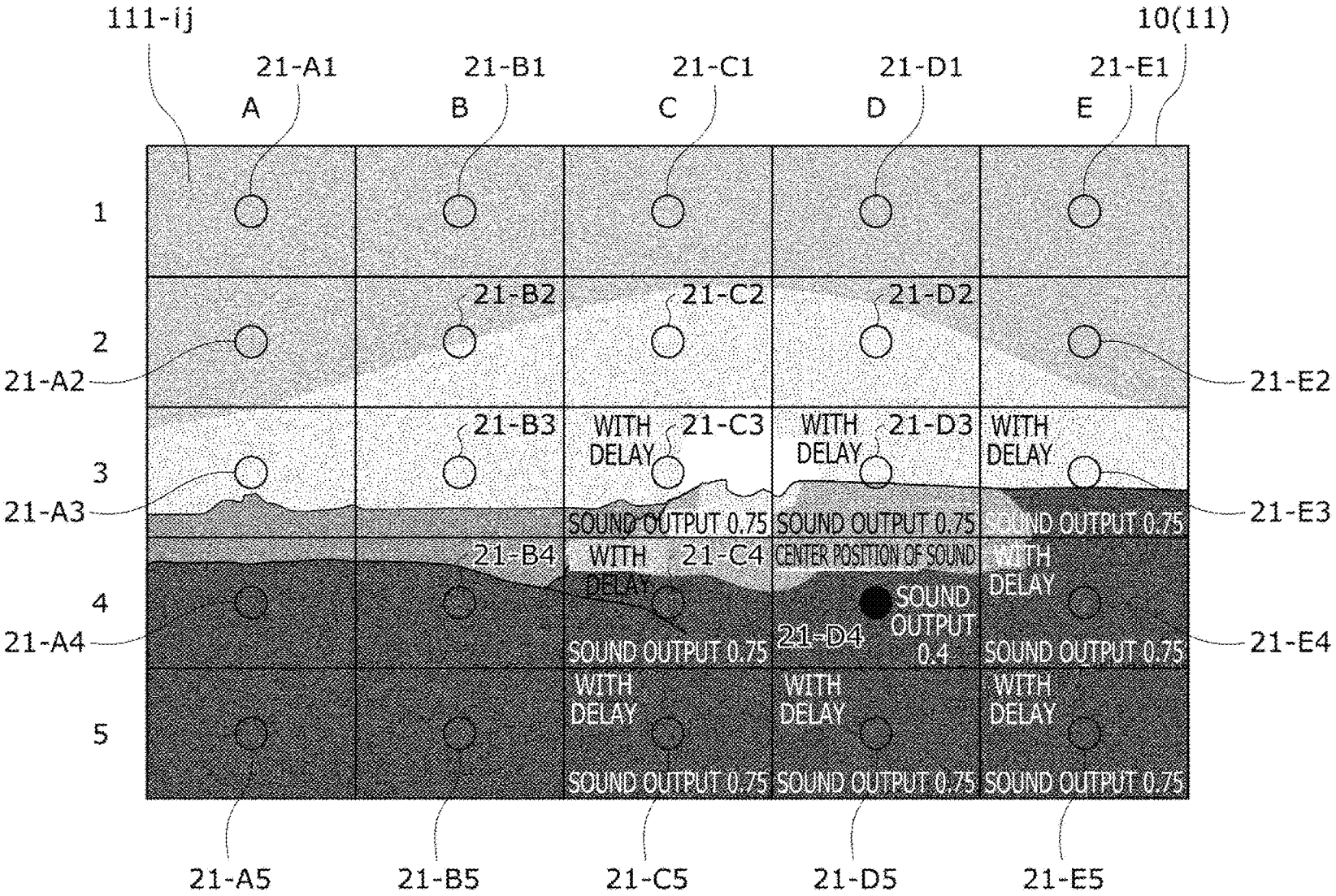
FIG. 7 is a view depicting an example of screen multiplexing drive to which the present technology is applied.

FIG. 7 depicts an example of the screen multiplexing drive to which the present technology is applied.

In FIG. 7, from among 5×5 divisional blocks 111 on the screen of the display cell 11 of the panel unit 10, the vibrator 21-D4 provided in the divisional block 111-D4 is determined as a sound output vibrator, and eight vibrators 21 (21-C3, 21-C4, 21-C5, 21-D3, 21-D5, 21-E3, 21-E4, and 21-E5) provided around the vibrator 21-D4 are determined as dispersion sound output vibrators.

Here, a sound signal is reproduced not only from the vibrator 21-D4 corresponding to the position of the sound source (center position of sound) but is reproduced dispersedly also from the eight vibrators 21 deployed in the surrounding area of the vibrator 21-D4 ("sound output 0.75" in FIG. 7). Therefore, dispersion of heat by heat generation of the vibrator 21 is performed, and the influence of heat on the picture quality of an image to be displayed on the display cell 11 is reduced.

Figure 8:
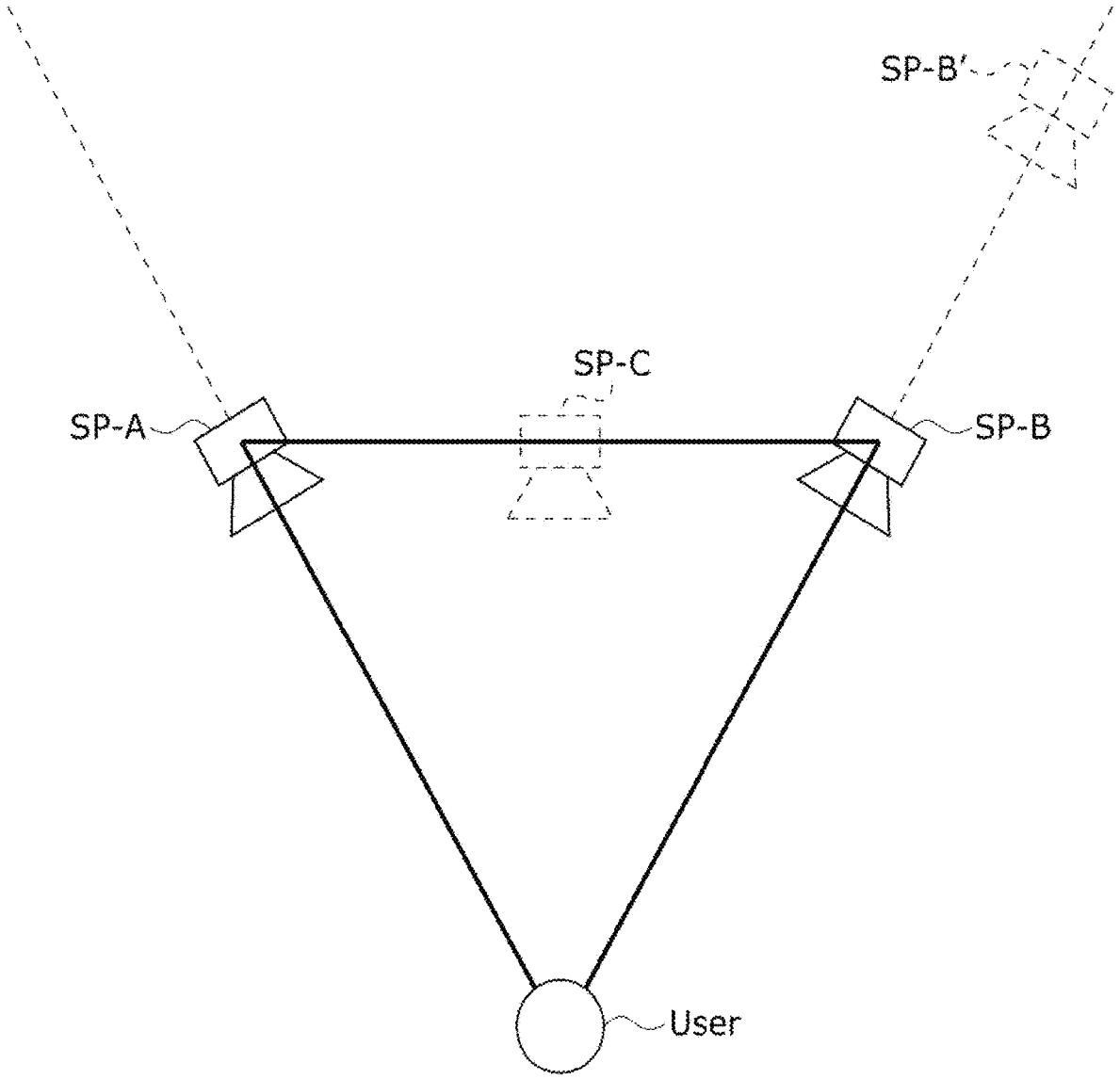
FIG. 8 is a view depicting a principle of a preceding sound effect.

Further, at this time, in the eight vibrators 21 deployed in the surrounding area of the vibrator 21-D4, the dispersed sound signals have undergone delaying ("with delay" in FIG. 7), the localization of the sound output position is prevented from being impaired due to the preceding sound effect. FIG. 8 depicts the principle of the preceding sound effect.

The preceding sound effect is an effect that, in a case where a certain sound is generated and the sound is generated from a different location after a delay of approximately several ms to several tens of ms (for example, approximately 1 to 30 ms), it is felt that a single sound is emitted from the location of the preceding sound. This preceding sound effect is also called Haas effect.

Referring to FIG. 8, a case is supposed in which speakers SP-A and SP-B are deployed one by one to the left and the right with respect to a user (User). In this case, when a same sound is emitted with an equal sound volume from the left side speaker SP-A and the right side speaker SP-B, the user feels that the sound comes from a virtual image SP-C at a middle position between the deployment positions of the speakers SP-A and SP-B.

On the other hand, a case is supposed in which the deployment position of the right side speaker SP-B is moved farther with respect to the user from the position of the speaker SP-B to the position of a speaker SP-B'. In this case, when a same sound is emitted with a same sound volume from the left side speaker SP-A and the right side speaker SP-B', since the sound from the left side speaker SP-A reaches first, the user hears the sound only from the left side speaker SP-A, and the user feels that even the sound emitted actually from the right side speaker SP-B' sounds from the left side.

It is to be noted that, although, in the example of FIG. 7, the dispersion sound output vibrators are vibrators 21 in the surrounding area of the sound output vibrator, they may be vibrators 21 other than those in the surrounding area of the sound output vibrator. However, in a case where vibrators 21 in the surrounding area of the sound output vibrator (nearest surrounding vibrators 21) are selected as the vibrators 21 that are to serve as dispersion sound output vibrators, improved sound quality is obtained in comparison with that in an alternative case in which vibrators 21 other than those in the surrounding area of the sound output vibrator are selected.

Figure 9:
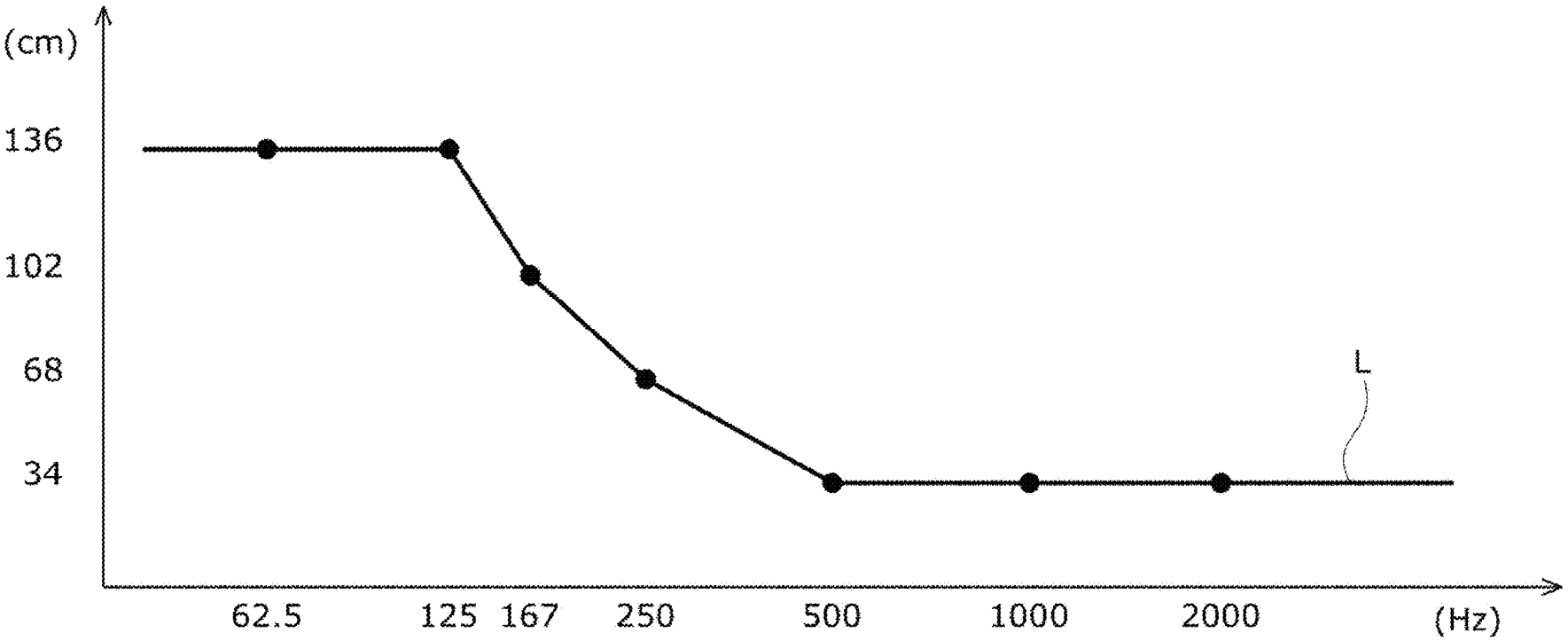
FIG. 9 is a view depicting an example of a dispersible range.

FIG. 9 depicts an example of a dispersible range in a case where vibrators 21 adjacent to each other are spaced by a predetermined distance from each other. In FIG. 9, in a case where the axis of abscissa is the reproduction frequency (Hz) of a sound signal and the axis of ordinate is the distance (cm) between the vibrators 21, the dispersible range when the distance between the adjacent vibrators 21 is 34 cm is represented by a line graph L.

This line graph L represents that, in a case where the reproduction frequency is higher than a predetermined frequency (for example, 500 Hz or more), it is necessary to secure the sound quality by using vibrators 21 in the surrounding area (for example, within the range of 34 cm) of the sound output vibrator as dispersion sound output vibrators to output sound dispersedly.

In particular, in a case where the vibrator 21-D4 is the sound output vibrator (reference), when the reproduction frequency is 500 Hz, the dispersible range is 34 cm, and therefore, the vibrators 21-C4, 21-D3, 21-D5, 21-E4, and so forth provided in the surrounding area of the reference deployment position can be determined as dispersion sound output vibrators.

On the other hand, the line graph L represents that, in a case where the reproduction frequency is a frequency lower than a predetermined frequency (for example, 125 Hz or less), even if vibrators 21 other than those in the surrounding area of the sound output vibrator are used as dispersion sound output vibrators such that sound is outputted dispersedly to a broader range (for example, within a range of 136 cm), sound quality degradation is less likely to occur.

In particular, in a case where the vibrator 21-D4 is determined as the sound output vibrator (reference), when the reproduction frequency is 200 Hz, the dispersible range is 84 cm, and therefore, in addition to the vibrators 21 provided in the surrounding area of the reference deployment position, vibrators 21 deployed in a wider range such as the vibrator 21-B4 and the vibrator 21-D2 can be used as dispersion sound output vibrators.

In such a manner, since the dispersible range of the sound output vibrator changes in response to the reproduction frequency of a sound signal, dispersion sound output vibrators are selected in accordance with the dispersible range. It is to be noted that, as an aim of the dispersible range, for example, in a case where the reproduction frequency is represented in wavelength, dispersion outputting may be performed within a half wavelength.

First Example

Now, as an example of the control method of the screen multiplexing drive to which the present technology is applied, simple division control is described with reference to FIG. 10.

Figure 10:
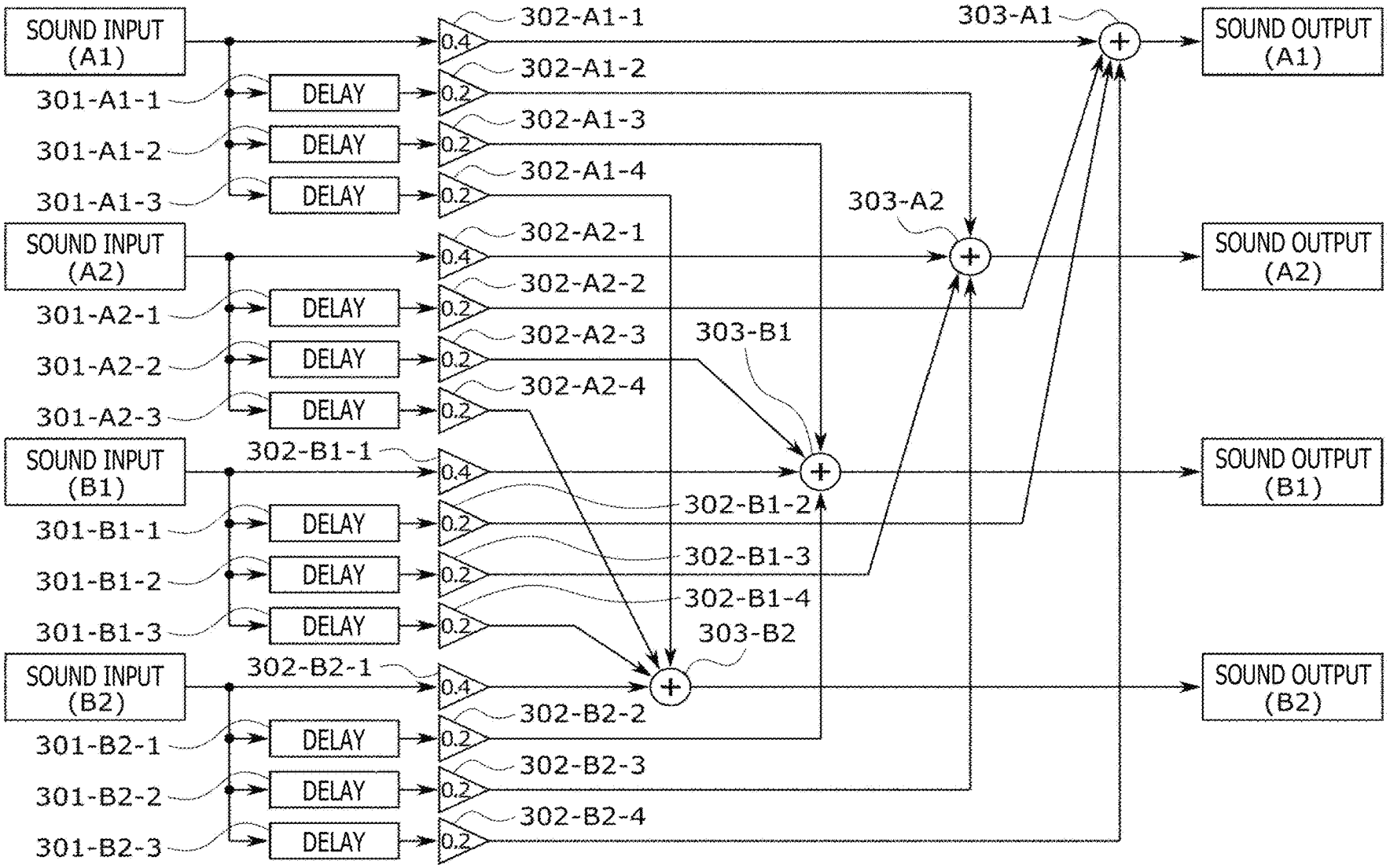
FIG. 10 is a view depicting a first example of a control method of screen multiplexing drive to which the present technology is applied.

FIG. 10 depicts a configuration of the signal processing unit 36 and the matrix 37 in the sound processing unit 35 (FIG. 6). The signal processing unit 36 includes delayers 301 and amplifiers 302. The matrix 37 includes adders 303.

In particular, referring to FIG. 10, the signal processing unit 36 and the matrix 37 generate sound signals A1, A2, B1, and B2 to be outputted to vibrators 21-A1, 21-A2, 21-B1, and 21-B2 provided for the 2×2 division blocks 111-A1, 111-A2, 111-B1, and 111-B2, respectively.

It is to be noted that, although a case is described in which, in the configuration of FIG. 10, a sound signal is outputted to the vibrator 21 provided in each of the 2×2 divisional blocks 111 for simplified description, similar processing can be applied also to such a case of the 5×5 divisional blocks 111 as described hereinabove and so forth.

In the signal processing unit 36-A1, the sound signal A1 inputted thereto is inputted respectively to the amplifier 302-A1-1 and the delayers 301-A1-1 to 301-A1-3.

The amplifier 302-A1-1 amplifies the sound signal A1 inputted thereto with a designated gain (0.4) and outputs the amplified sound signal A1 to the adder 303-A1.

The delayer 301-A1-1 delays the sound signal A1 inputted thereto by a predetermined delay amount and outputs the delayed sound signal A1 to the amplifier 302-A1-2. The amplifier 302-A1-2 amplifies the sound signal A1 inputted thereto from the delayer 301-A1-1 with a designated gain (0.2) and outputs the amplified sound signal A1 to the adder 303-A2.

The delayer 301-A1-2 delays the sound signal A1 inputted thereto by a predetermined delay amount and outputs the delayed sound signal A1 to the amplifier 302-A1-3. The amplifier 302-A1-3 amplifies the sound signal A1 inputted thereto from the delayer 301-A1-2 with a designated gain (0.2) and outputs the amplified sound signal A1 to the adder 303-B1.

The delayer 303-A1-3 delays the sound signal A1 inputted thereto by a predetermined delay amount and outputs the delayed sound signal A1 to the amplifier 302-A1-4. The amplifier 302-A1-4 amplifies the sound signal A1 inputted thereto from the delayer 303-A1-3 with a designated gain (0.2) and outputs the amplified sound signal A1 to the adder 303-B2.

In particular, the signal processing unit 36-A1 multiplies the sound signal A1 inputted thereto by a gain to sort the sound signal A1 with a predetermined sound pressure level (sound volume) such that the sound signal A1 is outputted not only to the vibrator 21-A1 but also to the vibrators 21-A2, 21-B1, and 21-B2. Further, at this time the sound signals A1 to be outputted to the vibrators 21-A2, 21-B1, and 21-B2 are delayed such that the preceding sound effect is implemented.

In the signal processing unit 36-A2, the sound signal A2 inputted thereto is inputted to the amplifier 302-A2-1 and the delayers 301-A2-1 to 301-A2-3.

The delayers 301-A2-1 to 301-A2-3 and the amplifiers 302-A2-1 to 302-A2-4 perform signal processing for delaying or amplification for the sound signal A2 inputted thereto. Then, the sound signals A2 from the amplifiers 302-A2-1 to 302-A2-4 are outputted to the adders 303-A2, 303-A1, 303-B1, and 303-B2, respectively.

In particular, the signal processing unit 36-A2 sorts the sound signal A2 inputted thereto with predetermined sound pressure levels so as to be outputted not only to the vibrator 21-A2 but also to the vibrators 21-A1, 21-B1, and 21-B2 after a delay.

In the signal processing unit 36-B1, the sound signal B1 inputted thereto is inputted to the amplifier 302-B1-1 and the delayers 301-B1-1 to 301-B1-3.

The delayers 301-B1-1 to 301-B1-3 and the amplifiers 302-B1-1 to 302-B1-4 perform signal processing for delaying or amplification for the sound signal B1 inputted thereto. Then, the sound signals B1 from the amplifiers 302-B1-1 to 302-B1-4 are outputted to the adders 303-B1, 303-A1, 303-A2, and 303-B2, respectively.

In particular, the signal processing unit 36-B1 sorts the sound signal B1 inputted thereto with predetermined sound pressure levels so as to be outputted not only to the vibrator 21-B1 but also to the vibrators 21-A1, 21-A2, and 21-B2 after a delay.

In the signal processing unit 36-B2, the sound signal B2 inputted thereto is inputted respectively to the amplifier 302-B2-1 and the delayers 301-B2-1 to 301-B2-3.

The delayers 301-B2-1 to 301-B2-3 and the amplifiers 302-B2-1 to 302-B2-4 perform signal processing for delaying or amplification for the sound signal B2 inputted thereto. Then, the sound signals B2 from the amplifiers 302-B2-1 to 302-B2-4 are outputted to the adders 303-B2, 303-B1, 303-A2, and 303-A1, respectively.

In particular, the signal processing unit 36-B2 sorts the sound signal B2 inputted thereto with predetermined sound pressure levels so as to be outputted not only to the vibrator 21-B2 but also to the vibrators 21-A1, 21-A2, and 21-B1 after a delay, respectively.

To the adder 303-A1, the sound signal A1 from the amplifier 302-A1-1, the sound signal A2 from the amplifier 302-A2-2, the sound signal B1 from the amplifier 302-B1-2, and the sound signal B2 from the amplifier 302-B2-4 are inputted.

The adder 303-A1 adds the sound signals A1, A2, B1, and B2 inputted thereto and outputs the sum signal as a sound signal A1. In short, in the sound signal A1 outputted to the vibrator 21-A1, the delayed sound signals A2, B1, and B2 are added in sound pressure to the inputted sound signal A1.

The adder 303-A2 adds the sound signal A1 from the amplifier 302-A1-2, the sound signal A2 from the amplifier 302-A2-1, the sound signal B1 from the amplifier 302-B1-3, and the sound signal B2 from the amplifier 302-B2-3 inputted thereto and outputs a result of the addition as a sound signal A2. In the sound signal A2, the delayed sound signals A1, B1, and B2 are added in sound pressure to the inputted sound signal A2.

The adder 303-B1 adds the sound signal A1 from the amplifier 302-A1-3, the sound signal A2 from the amplifier 302-A2-3, the sound signal B1 from the amplifier 302-B1-1, and the sound signal B2 from the amplifier 302-B2-2 inputted thereto and outputs a result of the addition to as a sound signal B1. In the sound signal B1, the delayed sound signals A1, A2, and B2 are added in sound pressure to the inputted sound signal B1.

The adder 303-B2 adds the sound signal A1 from the amplifier 302-A1-4, the sound signal A2 from the amplifier 302-A2-4, the sound signal B1 from the amplifier 302-B1-4, and the sound signal B2 from the amplifier 302-B2-1 inputted thereto and outputs a result of the addition to as a sound signal B2. In the sound signal B2, the delayed sound signals A1, A2, and B1 are added in sound pressure to the inputted sound signal B2.

The sound signals A1, A2, B1, and B2 outputted in such a manner are inputted to the amplifiers 38-A1, 38-A2, 38-B1, and 38-B2, respectively, and are outputted to the vibrators 21-A1, 21-A2, 21-B1, and 21-B2, respectively.

As described hereinabove, in the simple division control, each of the sound signals A1, A2, B1, and B2 outputted to the vibrators 21-A1, 21-A2, 21-B1, and 21-B2 is controlled so as to include sound pressure levels of delayed other sound signals. Consequently, since a sound signal is reproduced dispersedly, dispersion of heat is implemented, and the influence of heat on the picture quality of an image to be displayed on the display cell 11 can be reduced. Further, since the other sound signals are delayed, the preceding sound effect is implemented and the localization of the sound output position is not impaired either.

Second Example

Figure 11:
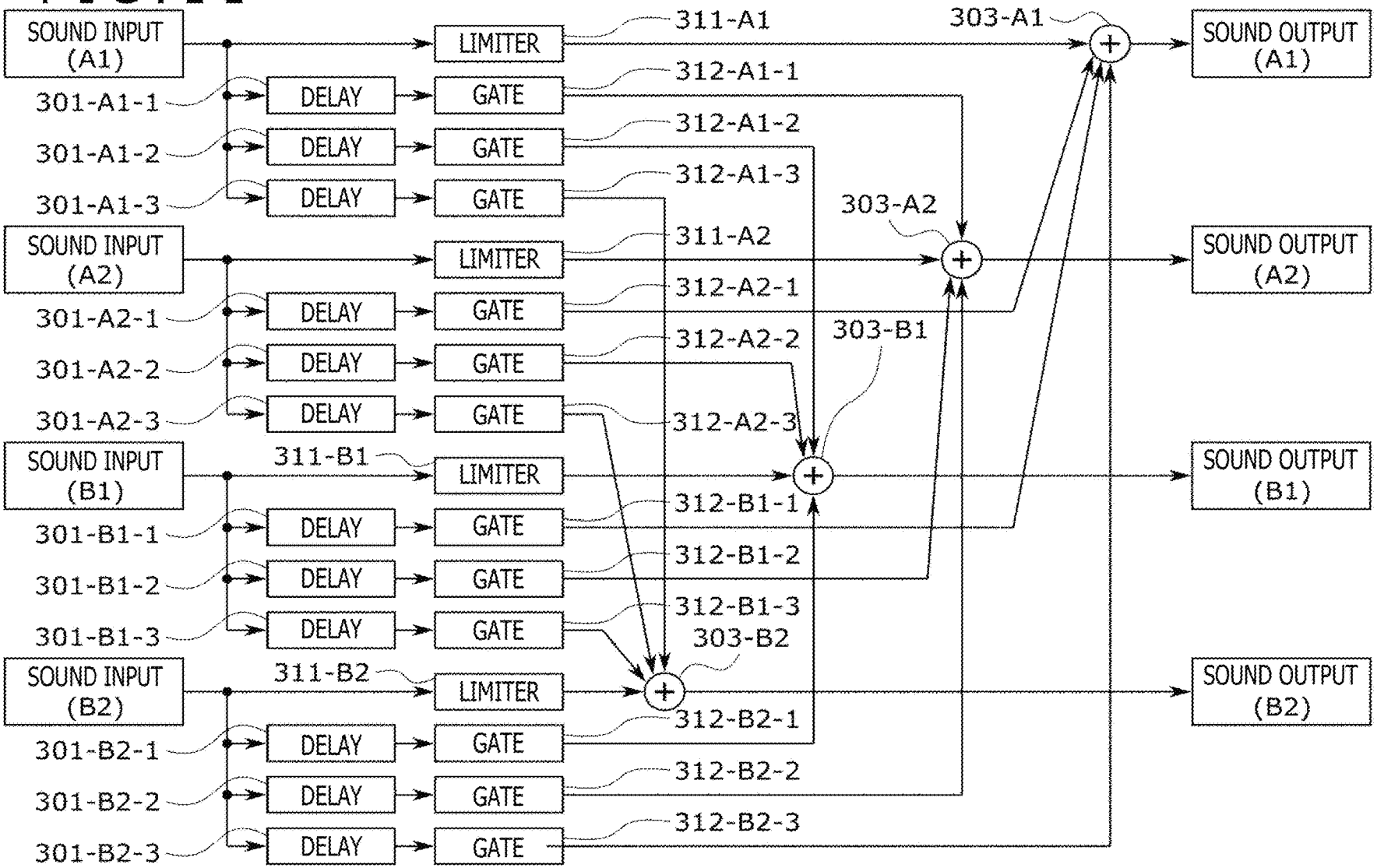
FIG. 11 is a view depicting a second example of the control method of screen multiplexing drive to which the present technology is applied.
Figure 12:
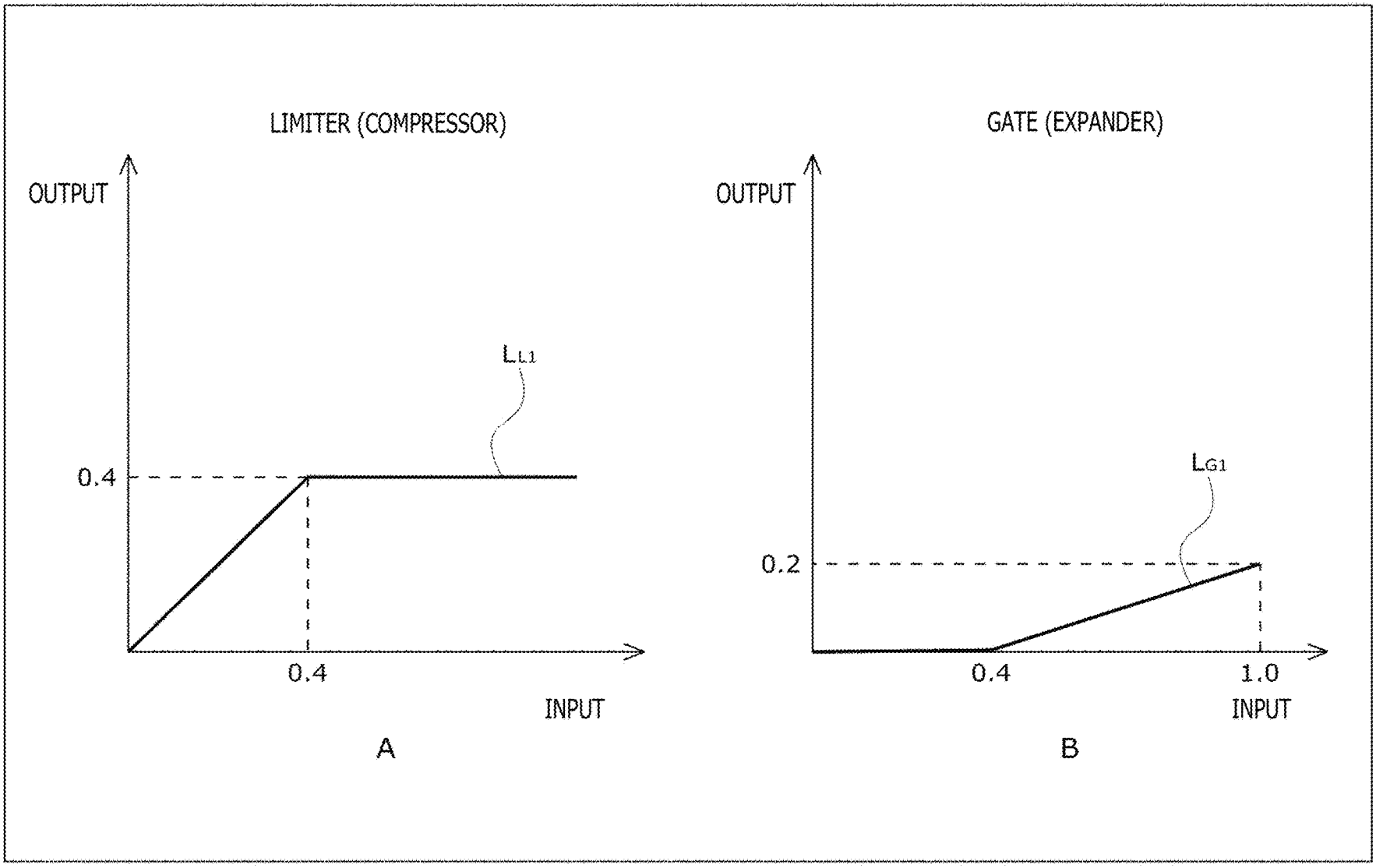
FIG. 12 illustrates views each depicting an example of a relationship between an input and an output of a limiter and a gate of FIG. 11.

Now, dynamic division control is described as an example of the control method of the screen multiplexing drive with reference to FIGS. 11 and 12.

FIG. 11 depicts a configuration of the signal processing unit 36 and the matrix 37 in the sound processing unit 35 (FIG. 6). The configuration ready for the dynamic division control of FIG. 11 includes limiters 311 and gates 312 in place of the amplifiers 302 in comparison with the configuration ready for the simple division control of FIG. 10.

In FIG. 11, limiters 311-A1, 311-A2, 311-B1, and 311-B2 are provided in place of the amplifiers 302-A1-1, 302-A2-1, 302-B1-1, and 302-B2-1 of FIG. 10.

Further, in FIG. 11, gates 312-A1-1 to 312-A1-3, 312-A2-1 to 312-A2-3, 312-B1-1 to 312-B1-3, and 312-B2-1 to 312-B2-3 are provided in place of the amplifiers 302-A1-2 to 302-A1-4, 302-A2-2 to 302-A2-4, 302-B1-2 to 302-B1-4, and 302-B2-2 to 302-B2-4 of FIG. 10.

The limiter 311-A1 performs a limiter process for the sound signal A1 inputted thereto and outputs a sound signal A1 obtained as a result of the limiter process to the adder 303-A1.

Here, A of FIG. 12 depicts an example of a relationship between an input and an output when the limiter process is performed. In A of FIG. 12, a relationship between the input and the output when the axis of abscissa indicates the input to the limiter 311 and the axis of ordinate indicates the output from the limiter 311 is represented by a line graph $L_{L1}$.

In A of FIG. 12, by the limiter process, the maximum value of the sound pressure level (sound volume) is limited to a predetermined value (0.4), and although the input and the output are equal until the input becomes 0.4, if the input becomes equal to or higher than 0.4, then the output is limited to 0.4 and is limited to the same sound pressure level.

It is to be noted that, although the limiter process is described here, a compressor process may otherwise be performed which compresses the sound pressure level so as not to become equal to or higher than a predetermined value. In particular, in the compressor process, when the sound pressure level is equal to or lower than the predetermined value, sound pressure reduction is not performed, but for a sound signal whose sound pressure level is equal to or higher than the predetermined value, suppression control is performed such that the sound pressure level of the sound signal does not become equal to or higher than the predetermined value.

Referring back to the description of FIG. 11, the limiters 311-A2, 311-B1, and 311-B2 perform a limiter process for the sound signals A2, B1, and B2 similarly to the limiter 311-A1, respectively, and output resulting sound signals A2, B1, and B2 to the adders 303-A2, 303-B1, and 303-B2, respectively.

The gate 312-A1-1 performs a gate process for the sound signal A1 inputted from the delayers 301-A1-1 and outputs a sound signal A1 obtained as a result of the gate process to the adder 303-A2.

Here, B of FIG. 12 depicts an example of a relationship between the input and the output when the gate process is performed. In B of FIG. 12, the relationship between the input and the output when the axis of abscissa indicates the input to the gate 312 and the axis of ordinate indicates the output from the gate 312 is represented by a line graph $L_{G1}$.

In B of FIG. 12, a sound pressure level (sound volume) equal to or lower than a predetermined value is not passed by the gate process, and when the input becomes equal to or higher than 0.4, the sound pressure level is outputted, and if the input becomes 1.0, then the output becomes 0.2. It is to be noted that, although the gate process is described here, an expander process may otherwise be performed which lowers a sound pressure level equal to or lower than the predetermined value.

Referring back to FIG. 11, the gates 312-A1-2 and 312-A1-3 perform a gate process for the sound signals A1 inputted from the delayers 301-A1-2 and 301-A1-3, respectively, similarly to the gate 312-A1-1 and outputs resulting sound signals A1 to the adders 303-B1 and 303-B2, respectively.

The gates 312-A2-1 to 312-A2-3 perform a gate process for the sound signals A2 inputted from the delayers 301-A2-1 to 301-A2-3, respectively, and output resulting sound signals A2 to the adders 303-A1, 303-B1, and 303-B2, respectively.

The gates 312-B1-1 to 312-B1-3 perform a gate process for the sound signals B1 inputted from the delayers 301-B1-1 to 301-B1-3, respectively, and outputs resulting sound signals B1 to the adders 303-A1, 303-A2, and 303-B2, respectively.

The gates 312-B2-1 to 312-B2-3 perform a gate process for the sound signals B2 inputted from the delayers 301-B2-1 to 301-B2-3, respectively, and outputs resulting sound signals B2 to the adders 303-A1, 303-A2, and 303-B1, respectively.

The adder 303-A1 adds the sound signal A1 from the limiter 311-A1, the sound signal A2 from the gate 312-A2-1, the sound signal B1 from the gate 312-B1-1, and the sound signal B2 from the gate 312-B2-3 inputted thereto and outputs a result of the addition as a sound signal A1.

The adder 303-A2 adds the sound signal A1 from the gate 312-A1-1, the sound signal A2 from the limiter 311-A2, the sound signal B1 from the gate 312-B1-2, and the sound signal B2 from the gate 312-B2-2 inputted thereto and outputs a result of the addition as a sound signal A2.

The adder 303-B1 adds the sound signal A1 from the gate 312-A1-2, the sound signal A2 from the gate 312-A2-2, the sound signal B1 from the limiter 311-B1, and the sound signal B2 from the gate 312-B2-1 inputted thereto and outputs a result of the addition as a sound signal B1.

The adder 303-B2 adds the sound signal A1 from the gate 312-A1-3, the sound signal A2 from the gate 312-A2-3, the sound signal B1 from the gate 312-B1-3, and the sound signal B2 from the limiter 311-B2 inputted thereto and outputs a result of the addition as a sound signal B2.

The sound signals A1, A2, B1, and B2 outputted in such a manner are outputted to the vibrators 21-A1, 21-A2, 21-B1, and 21-B2, respectively.

As described hereinabove, in the dynamic division control, each of the sound signals A1, A2, B1, and B2 to be outputted to the vibrators 21-A1, 21-A2, 21-B1, and 21-B2 is controlled by the limiter process and the gate process such that it includes sound pressure levels of delayed other sound signals. Consequently, since the sound signals are reproduced dispersedly, dispersion of heat is implemented, and the influence of heat upon the picture quality of an image to be displayed on the display cell 11 can be reduced. Further, since the other sound signals have undergone delaying, the preceding sound effect is implemented, and the localization of the sound output position is not impaired either.

Third Example

Figure 13:
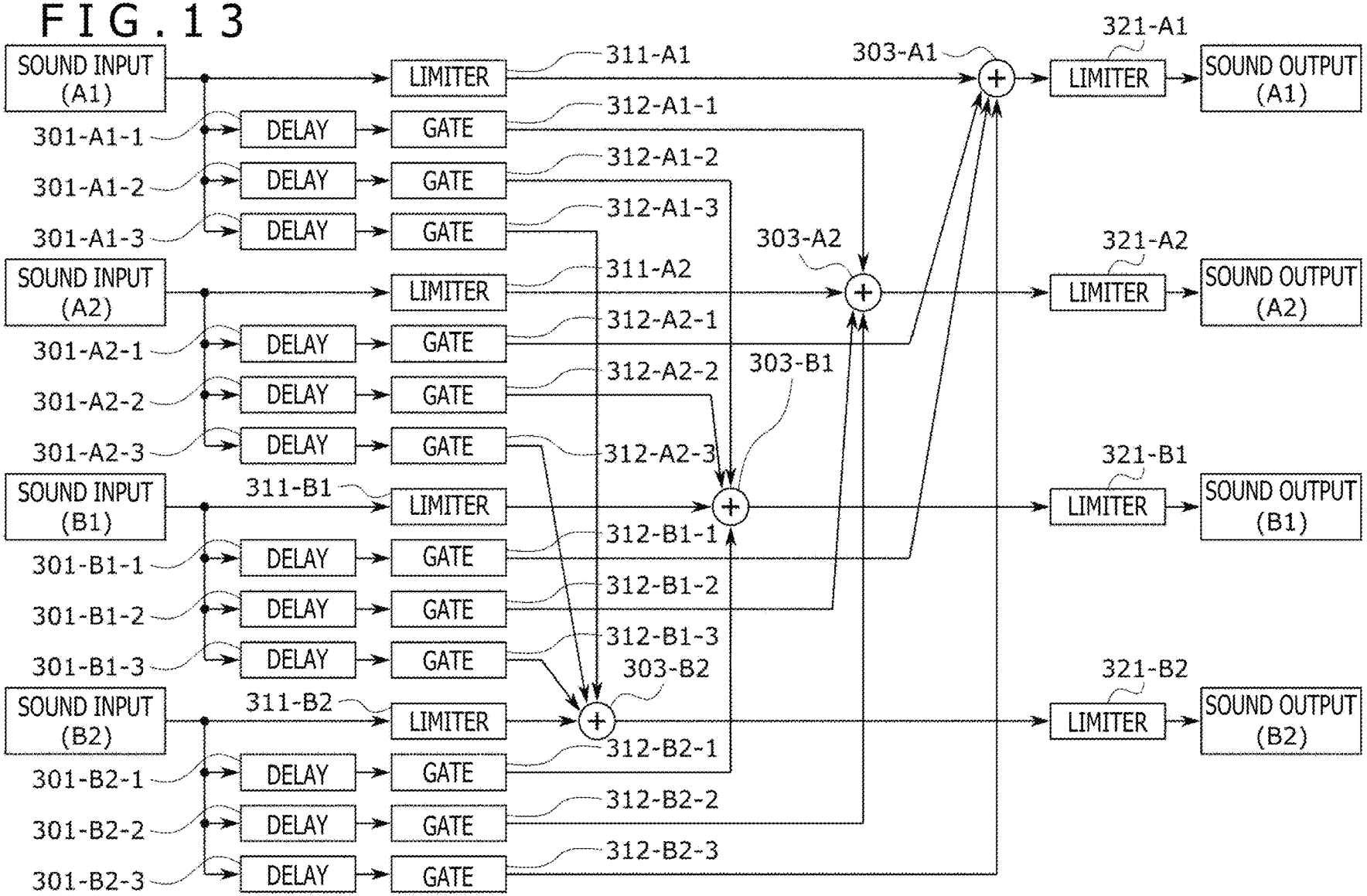
FIG. 13 is a view depicting a third example of the control method of screen multiplexing drive to which the present technology is applied.
Figure 14:
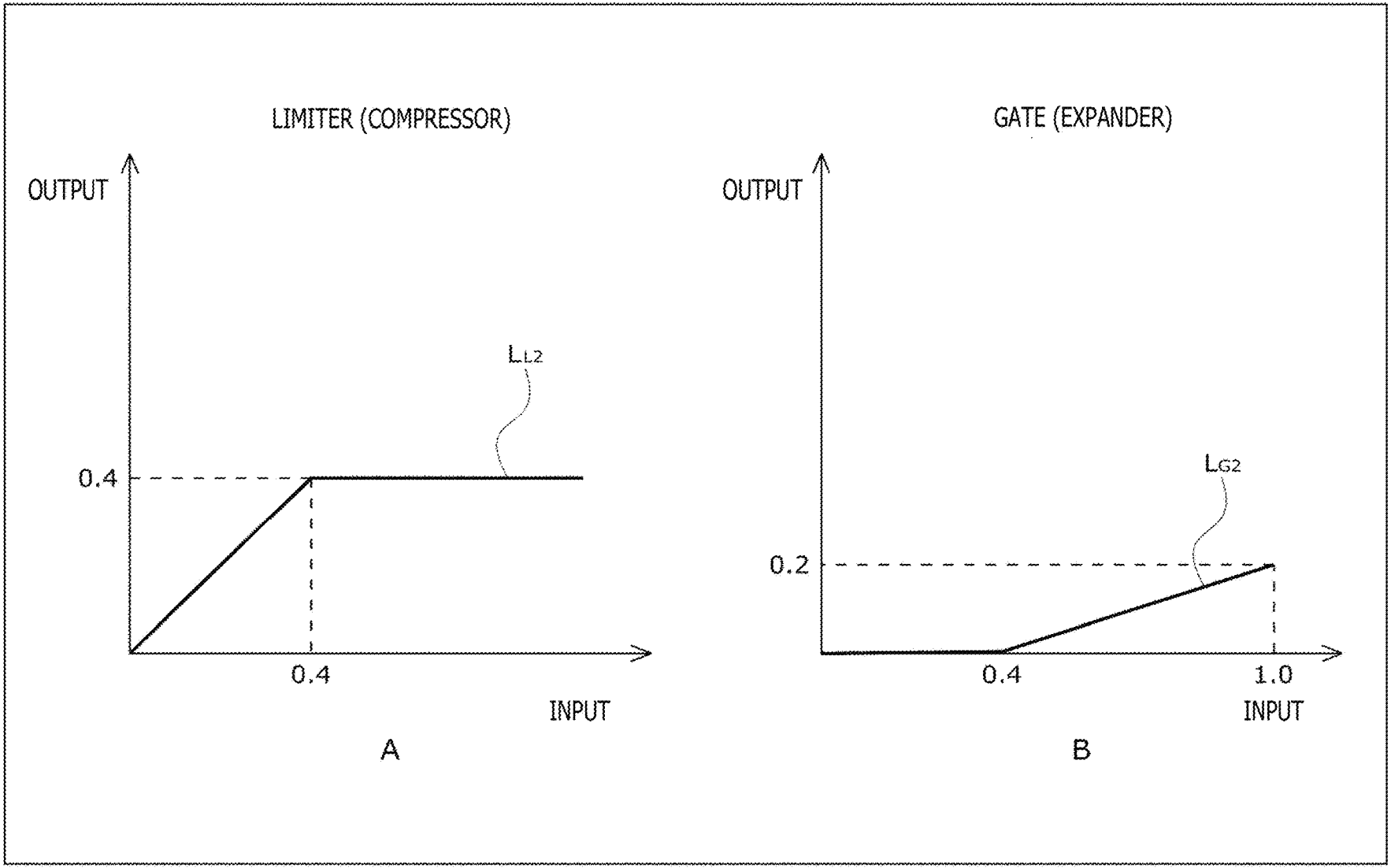
FIG. 14 illustrates views each depicting an example of a relationship between an input and an output of a limiter and a gate of FIG. 13.

Now, control that takes, when the dynamic division control is performed, maximum output suppression of balance priority into account is described as an example of the control method of the screen multiplexing drive with reference to FIGS. 13 and 14.

FIG. 13 depicts a configuration of the signal processing unit 36 and the matrix 37 in the sound processing unit 35 (FIG. 6). While the configuration ready for the dynamic division control of FIG. 13 includes, in comparison with the configuration ready for the dynamic division control of FIG. 11, delayers 301, adders 303, limiters 311, and gates 312 configured similarly, it newly includes limiters 321 provided at the following stage of the adders 303.

It is to be noted that examples of a limiter process performed by the limiters 311 and 321 and a gate process performed by the gates 312 are respectively depicted in A and B of FIG. 14. Here, in place of the limiter process, a compressor process may be performed. Further, in place of the gate process, an expander process may be performed.

In FIG. 13, the limiters 321-A1, 321-A2, 321-B1, and 321-B2 are provided at the following stage of the adders 303-A1, 303-A2, 303-B1, and 303-B2, respectively.

The limiter 321-A1 performs a limiter process for the sound signal A1 inputted from the adder 303-A1 and outputs a sound signal A1 obtained as a result of the limiter process. By this limiter process, the maximum output of the sound signal A1 is suppressed.

The limiters 321-A2, 321-B1, and 321-B2 perform a limiter process for the sound signals A2, B1, and B2 inputted from the adders 303-A2, 303-B1, and 303-B2, respectively, similarly to the limiter 321-A1. By this limiter process, the maximum output of the sound signals A2, B1, and B2 is suppressed.

As above, in the dynamic division control that takes maximum output suppression of balance priority into account, the maximum output of a sound signal to be outputted is suppressed by the limiter 321 provided at the following stage of the adder 303 of each channel. At this time, in each channel, since the sound signal of the own channel is limited by the limiter 311, it is considered that the balance of sound signals of the channels takes priority.

Fourth Example

Figure 15:
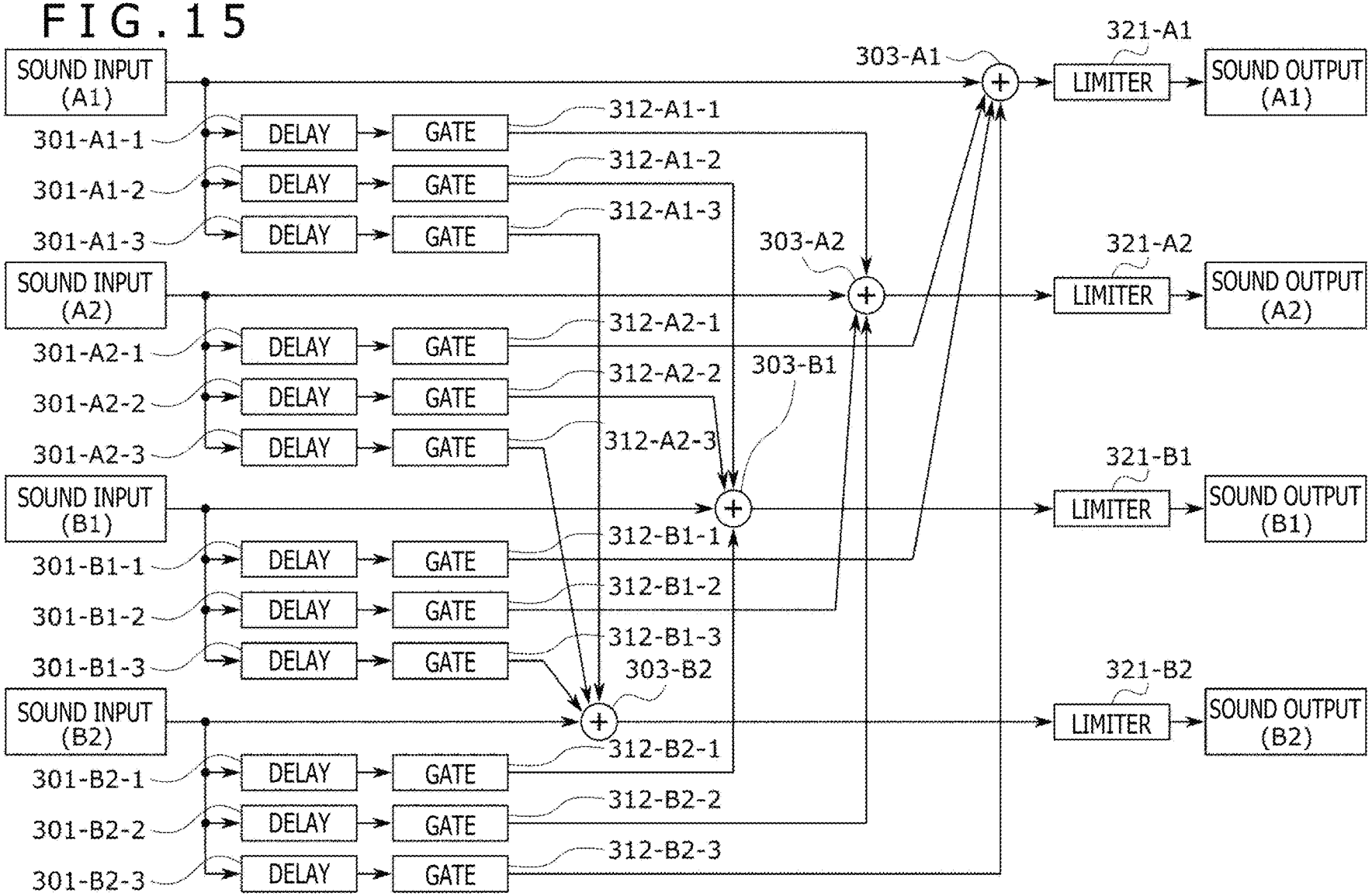
FIG. 15 is a view depicting a fourth example of the control method of screen multiplexing drive to which the present technology is applied.
Figure 16:
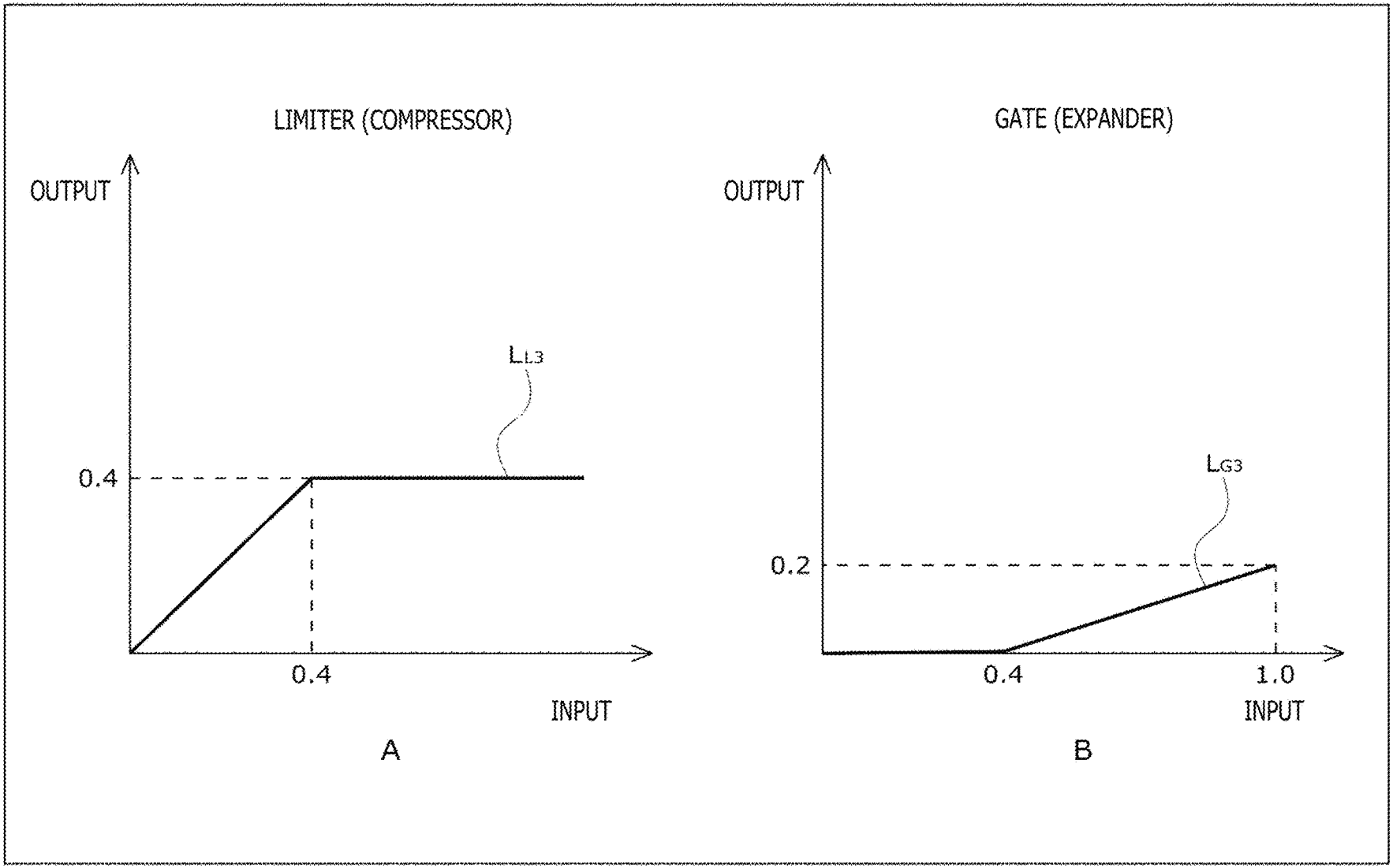
FIG. 16 illustrates views each depicting an example of a relationship between an input and an output of a limiter and a gate of FIG. 15.

Finally, control that takes maximum output suppression of own channel priority into account when the dynamic division control is performed is described as an example of the control method of the screen multiplexing drive with reference to FIGS. 15 and 16.

FIG. 15 depicts a configuration of the signal processing unit 36 and the matrix 37 in the sound processing unit 35 (FIG. 6). Although the configuration ready for the dynamic division control of FIG. 15 includes, in comparison with the configuration ready for the dynamic division control of FIG. 11, delayers 301, adders 303, and gates 312 configured similarly, it includes limiters 321 provided at the following stage of the adders 303 while the limiters 311 are removed.

It is to be noted that examples of the limiter process performed by the limiters 321 and the gate process performed by the gates 312 are respectively depicted in A and B of FIG. 16. Here, in place of the limiter process, a compressor process may be performed. Further, in place of the gate process, an expander process may be performed.

The adder 303-A1 adds the sound signal A1 inputted thereto from the outside, the sound signal A2 from the gate 312-A2-1, the sound signal B1 from the gate 312-B1-1, and the sound signal B2 from the gate 312-B2-3 and outputs a result of the addition to the limiter 321-A1.

The limiter 321-A1 performs a limiter process for the sound signal A1 inputted from the adder 303-A1 and outputs a sound signal A1 obtained as a result of the limiter process. By this limiter process, the maximum output of the sound signal A1 is suppressed.

The adder 303-A2 adds the sound signal A1 from the gate 312-A1-1, the sound signal A2 inputted from the outside, the sound signal B1 from the gate 312-B1-2, and the sound signal B2 from the gate 312-B2-2 and outputs a result of the addition to the limiter 321-A2.

The limiter 321-A2 performs a limiter process for the sound signal A2 from the adder 303-A2 and outputs a sound signal A2 obtained as a result of the limiter process. By this limiter process, the maximum output of the sound signal A2 is suppressed.

The adder 303-B1 adds the sound signal A1 from the gate 312-A1-2, the sound signal A2 from the gate 312-A2-2, the sound signal B1 inputted from the outside, and the sound signal B2 from the gate 312-B2-1 and outputs a result of the addition to the limiter 321-B1.

The limiter 321-B1 performs a limiter process for the sound signal B1 from the adder 303-B1 and outputs a sound signal B1 obtained as a result of the limiter process. By this limiter process, the maximum output of the sound signal B1 is suppressed.

The adder 303-B2 adds the sound signal A1 from the gate 312-A1-3, the sound signal A2 from the gate 312-A2-3, the sound signal B1 from the gate 312-B1-3, and the sound signal B2 inputted from the outside and outputs a result of the addition to the limiter 321-B2.

The limiter 321-B2 performs a limiter process for the sound signal B2 from the adder 303-B2 and outputs a sound signal B2 obtained as a result of the limiter process. By this limiter process, the maximum output of the sound signal B2 is suppressed.

As above, in the dynamic division control that takes the maximum output suppression of own channel priority into account, the maximum output of a sound signal to be outputted is suppressed by the limiter 321 provided at the following stage of the adder 303 of each channel. At this time, since, in each channel, the sound signal of the own channel is not in a limited state, it is considered that the sound signal of the own channel takes priority.

<2. Modifications>

It is to be noted that, since one vibrator 21 has a limit to a sound pressure that can be outputted, in a case where a sufficient output sound pressure is not obtained at a certain vibrator 21, the present technology may be utilized, separately from the problem of heat generation of the vibrators 21 described hereinabove, in order to raise the output sound pressure such that the sound signal is dispersed to vibrators 21 in the surrounding area (or in an area other than the surrounding area).

Further, although the foregoing description describes that the vibrator 21 that is an actuator for a speaker serving as a vibration source includes a voice coil and, if sound current of an electric signal flows to the voice coil, then driving force is generated in the voice coil in accordance with the principle of electromagnetic action, the vibrator 21 is not limited to the voice coil but may be configured using another actuator such as a voltage actuator.

Also in a case where another actuator is used, it is supposed that heat generation by the other actuator may have an influence on operation. However, by applying the present technology, the influence by such heat generation can be suppressed.

Although the foregoing description exemplifies a case in which the display device 1 is a television receiver, the display device 1 is not limited to this and may be an electronic equipment such as a personal computer, a tablet terminal, a smartphone, a portable telephone set, a game machine, or a display device. Further, the display device 1 may be a digital signage, a medical monitor, a commercial monitor (professional monitor) for a broadcasting station, an on-vehicle display, or the like.

Further, in the display device 1, as the panel unit 10, an OLED (Organic Light Emitting Diode) display unit that is a display panel on which pixels each including a self light emitting element are deployed two-dimensionally, a CLED (Crystal Light Emitting Diode) display unit in which an LED is used for a pixel, a liquid crystal display unit that is a display panel in which pixels each including a liquid crystal element and a TFT (Thin Film Transistor) element are deployed two-dimensionally, and so forth can be used.

Furthermore, in the display device 1, a communication circuit (communication module) ready for a predetermined communication method, an HDMI (registered trademark) (High Definition Multimedia Interface), an interface that complies with a predetermined standard such as USB (Universal Serial Bus) may be provided. By this, in the display device 1, not only broadcasting content received through the tuner 31, but also communication content that is streaming distributed by a motion video distribution service (OTT (Over The Top) service or the like) through a communication network such as the Internet or recorded content recorded by a recording machine (recording and reproduction machine) are reproduced.

Further, the signal processing unit 30 or the sound processing unit 35 of FIG. 6 may be configured as a stand-alone device as a signal processing device. At this time, the signal processing device may be configured so as not to include part of the components such as the tuner 31, the image decoder 32, or the sound decoder 34 or may be configured so as to include other components.

It is to be noted that the embodiment of the present technology is not limited to the embodiment described hereinabove and can be altered in various manners without departing from the scope and the spirit of the present technology.

Further, the present technology can assume such configurations as described below.

(1)

A display device including:

a signal processing unit that processes an image signal and a sound signal;

a plate-like panel unit that displays an image according to the image signal; and a vibration unit that is deployed on a rear face side of the panel unit and causes the panel unit to vibrate in response to the sound signal, in which the vibration unit includes a plurality of vibrators, and the signal processing unit outputs the sound signal not only to a sound output vibrator that is a vibrator of an output target of the sound signal from among the plurality of vibrators but also to dispersion sound output vibrators that are vibrators of dispersion targets of the sound signal.

(2)

The display device according to (1) above, in which the signal processing unit delays the sound signal to be outputted to the dispersion sound output vibrators with respect to the sound signal to be outputted to the sound output vibrator.

(3)

The display device according to (1) or (2) above, in which each of the vibrators of the vibration unit is deployed for each predetermined region of the panel unit.

(4)

The display device according to (3) above, in which the dispersion sound output vibrators are deployed within a dispersible range according to a reproduction frequency of the sound signal with reference to a deployment position of the sound output vibrator.

(5)

The display device according to (4) above, in which, in a case where the reproduction frequency is a frequency higher than a predetermined frequency, a vibrator deployed in the surrounding area of the sound output vibrator is included in the dispersion sound output vibrators, and in a case where the reproduction frequency is a frequency lower than the predetermined frequency, a vibrator deployed in an area other than the surrounding area of the sound output vibrator is included in the dispersion sound output vibrators.

(6)

The display device according to (3) above, in which the dispersion sound output vibrators include a vibrator deployed in the surrounding area of the sound output vibrator.

(7)

The display device according to (2) above, in which the signal processing unit includes a first amplifier that amplifies a first sound signal to be outputted to the sound output vibrator with a first gain, a delayer that delays the first sound signal to be outputted to the dispersion sound output vibrators, a second amplifier that amplifies the delayed first sound signal with a second gain, and an adder that adds the first sound signal amplified by the first amplifier and a second sound signal that is to be outputted to the dispersion sound output vibrators and has undergone the delaying and the amplification.

(8)

The display device according to (2) above, in which the signal processing unit includes a first limiter/compressor that performs a limiter process or a compressor process for a first sound signal to be outputted to the sound output vibrator, a delayer that delays the first sound signal to be outputted to the dispersion sound output vibrators, a gate/expander that performs a gate process or an expander process for the delayed first sound signal, and an adder that adds the first sound signal having undergone the limiter process or the compressor process and a second sound signal that is to be outputted to the dispersion sound output vibrators and has undergone the delaying and the gate process or the expander process.

(9)

The display device according to (8) above, in which the signal processing unit further includes a second limiter/compressor that performs the limiter process or the compressor process for a sum signal generated by addition by the adder.

(10)

The display device according to (2) above, in which the signal processing unit includes a delayer that delays a first sound signal to be outputted to the dispersion sound output vibrators, a gate/expander that performs a gate process or an expander process for the delayed first sound signal, an adder that adds the first sound signal to be outputted to the sound output vibrator and a second sound signal that is to be outputted to the dispersion sound output vibrators and has undergone the delaying and the gate process or the expander process, and a limiter/compressor that performs a limiter process or a compressor process for a sum signal generated by addition by the adder.

(11)

The display device according to any one of (1) to (10) above, in which the signal processing unit processes an image signal and a sound signal of content.

(12)

The display device according to any one of (1) to (11) above, in which the display device is configured as a television receiver.

REFERENCE SIGNS LIST

1: Display device
10: Panel unit
11: Display cell
20: Vibration unit
21, 21-A1 to 21-E5: Vibrator
30: Signal processing unit
31: Tuner
32: Image decoder
33: Image processing unit
34: Sound decoder
35: Sound processing unit
36, 36-A1 to 36-E5: Signal processing unit
37: Matrix
38, 38-A1 to 38-E5: Amplifier
111, 111-A1 to 111-E5: Divisional block
301, 301-A1-1 to 301-B2-3: Delayer
302, 302-A1-1 to 302-B2-4: Amplifier
303, 303-A1 to 303-B2: Adder
311, 311-A1 to 311-B2: Limiter
312, 312-A1-1 to 312-B2-3: Gate
321, 321-A1 to 321-B2: Limiter

The invention claimed is:

1. A display device comprising:

a signal processing unit that processes an image signal and a sound signal;

a plate-like panel unit that displays an image according to the image signal; and a vibration unit that is deployed on a rear face side of the panel unit and causes the panel unit to vibrate in response to the sound signal, wherein the vibration unit includes a plurality of vibrators, and the signal processing unit outputs the sound signal not only to a sound output vibrator that is a vibrator of an output target of the sound signal from among the plurality of vibrators but also to dispersion sound output vibrators that are vibrators of dispersion targets of the sound signal, wherein the signal processing unit delays the sound signal to be outputted to the dispersion sound output vibrators with respect to the sound signal to be outputted to the sound output vibrator, and wherein the signal processing unit includes a first amplifier that amplifies a first sound signal to be outputted to the sound output vibrator with a first gain, a delayer that delays the first sound signal to be outputted to the dispersion sound output vibrators, a second amplifier that amplifies the delayed first sound signal with a second gain, and an adder that adds the first sound signal amplified by the first amplifier and a second sound signal that is to be outputted to the dispersion sound output vibrators and has undergone the delaying and the amplification.

2. The display device according to claim 1, wherein each of the vibrators of the vibration unit is deployed for each predetermined region of the panel unit.

3. The display device according to claim 2, wherein the dispersion sound output vibrators are deployed within a dispersible range according to a reproduction frequency of the sound signal with reference to a deployment position of the sound output vibrator.

4. The display device according to claim 3, wherein, in a case where the reproduction frequency is a frequency higher than a predetermined frequency, a vibrator deployed in a surrounding area of the sound output vibrator is included in the dispersion sound output vibrators, and in a case where the reproduction frequency is a frequency lower than the predetermined frequency, a vibrator deployed in an area other than the surrounding area of the sound output vibrator is included in the dispersion sound output vibrators.

5. The display device according to claim 2, wherein the dispersion sound output vibrators include a vibrator deployed in a surrounding area of the sound output vibrator.

6. The display device according to claim 1, wherein the signal processing unit processes an image signal and a sound signal of content.

7. The display device according to claim 6, wherein the display device is configured as a television receiver.

8. A display device comprising:

a signal processing unit that processes an image signal and a sound signal;

a plate-like panel unit that displays an image according to the image signal; and a vibration unit that is deployed on a rear face side of the panel unit and causes the panel unit to vibrate in response to the sound signal, wherein the vibration unit includes a plurality of vibrators, and the signal processing unit outputs the sound signal not only to a sound output vibrator that is a vibrator of an output target of the sound signal from among the plurality of vibrators but also to dispersion sound output vibrators that are vibrators of dispersion targets of the sound signal, wherein the signal processing unit delays the sound signal to be outputted to the dispersion sound output vibrators with respect to the sound signal to be outputted to the sound output vibrator, and wherein the signal processing unit includes a first limiter/compressor that performs a limiter process or a compressor process for a first sound signal to be outputted to the sound output vibrator, a delayer that delays the first sound signal to be outputted to the dispersion sound output vibrators, a gate/expander that performs a gate process or an expander process for the delayed first sound signal, and an adder that adds the first sound signal having undergone the limiter process or the compressor process and a second sound signal that is to be outputted to the dispersion sound output vibrators and has undergone the delaying and the gate process or the expander process.

9. The display device according to claim 8, wherein the signal processing unit further includes a second limiter/compressor that performs the limiter process or the compressor process for a sum signal generated by addition by the adder.

10. The display device according to claim 8, wherein each of the vibrators of the vibration unit is deployed for each predetermined region of the panel unit.

11. The display device according to claim 10, wherein the dispersion sound output vibrators are deployed within a dispersible range according to a reproduction frequency of the sound signal with reference to a deployment position of the sound output vibrator.

12. The display device according to claim 11, wherein, in a case where the reproduction frequency is a frequency higher than a predetermined frequency, a vibrator deployed in a surrounding area of the sound output vibrator is included in the dispersion sound output vibrators, and in a case where the reproduction frequency is a frequency lower than the predetermined frequency, a vibrator deployed in an area other than the surrounding area of the sound output vibrator is included in the dispersion sound output vibrators.

13. The display device according to claim 10, wherein the dispersion sound output vibrators include a vibrator deployed in a surrounding area of the sound output vibrator.

14. The display device according to claim 8, wherein the signal processing unit processes an image signal and a sound signal of content.

15. The display device according to claim 14, wherein the display device is configured as a television receiver.

16. A display device comprising:

a signal processing unit that processes an image signal and a sound signal;

a plate-like panel unit that displays an image according to the image signal; and a vibration unit that is deployed on a rear face side of the panel unit and causes the panel unit to vibrate in response to the sound signal, wherein the vibration unit includes a plurality of vibrators, and the signal processing unit outputs the sound signal not only to a sound output vibrator that is a vibrator of an output target of the sound signal from among the plurality of vibrators but also to dispersion sound output vibrators that are vibrators of dispersion targets of the sound signal, wherein the signal processing unit delays the sound signal to be outputted to the dispersion sound output vibrators with respect to the sound signal to be outputted to the sound output vibrator, and wherein the signal processing unit includes a delayer that delays a first sound signal to be outputted to the dispersion sound output vibrators, a gate/expander that performs a gate process or an expander process for the delayed first sound signal, an adder that adds the first sound signal to be outputted to the sound output vibrator and a second sound signal that is to be outputted to the dispersion sound output vibrators and has undergone the delaying and the gate process or the expander process, and a limiter/compressor that performs a limiter process or a compressor process for a sum signal generated by addition by the adder.

17. The display device according to claim 16, wherein each of the vibrators of the vibration unit is deployed for each predetermined region of the panel unit.

18. The display device according to claim 17, wherein the dispersion sound output vibrators are deployed within a dispersible range according to a reproduction frequency of the sound signal with reference to a deployment position of the sound output vibrator.

19. The display device according to claim 18, wherein, in a case where the reproduction frequency is a frequency higher than a predetermined frequency, a vibrator deployed in a surrounding area of the sound output vibrator is included in the dispersion sound output vibrators, and in a case where the reproduction frequency is a frequency lower than the predetermined frequency, a vibrator deployed in an area other than the surrounding area of the sound output vibrator is included in the dispersion sound output vibrators.

20. The display device according to claim 17, wherein the dispersion sound output vibrators include a vibrator deployed in a surrounding area of the sound output vibrator.

21. The display device according to claim 16, wherein the signal processing unit processes an image signal and a sound signal of content.

22. The display device according to claim 21, wherein the display device is configured as a television receiver.

* * * * *